US010245877B2

(12) United States Patent
Debartolo, Jr. et al.

(10) Patent No.: US 10,245,877 B2
(45) Date of Patent: Apr. 2, 2019

(54) INK DELIVERY SYSTEM

(71) Applicant: SANFORD L.P., Downers Grove, IL (US)

(72) Inventors: Daniel Francis Debartolo, Jr., Chicago, IL (US); Wing Sum Vincent Kwan, Chicago, IL (US); Bret R. Marschand, Glen Ellyn, IL (US); Ismail Akram, Cambridge (GB); Aidan P. Craigwood, Cambridge (GB); Kathrin Julia Holtzmann, Cambourne (GB); Stephen Sams, Bassingbourn (GB); Jim Bedolla, Downers Grove, IL (US)

(73) Assignee: Sanford, L.P., Atlanta, GA (US)

( * ) Notice: Subject to any disclaimer, the term of this patent is extended or adjusted under 35 U.S.C. 154(b) by 54 days.

(21) Appl. No.: 15/476,516

(22) Filed: Mar. 31, 2017

(65) Prior Publication Data

US 2017/0282633 A1 Oct. 5, 2017

Related U.S. Application Data

(60) Provisional application No. 62/316,528, filed on Mar. 31, 2016.

(51) Int. Cl.
*B43K 5/00* (2006.01)
*B43K 5/18* (2006.01)

(52) U.S. Cl.
CPC ..... *B43K 5/1827* (2013.01); *B43K 5/1845* (2013.01)

(58) Field of Classification Search
CPC ..... B43K 5/1827; B43K 5/1845
USPC ..... 401/196
See application file for complete search history.

(56) References Cited

U.S. PATENT DOCUMENTS

| | | | | |
|---|---|---|---|---|
| 3,738,760 | A * | 6/1973 | Madeira | A45D 34/048 401/195 |
| 5,480,250 | A * | 1/1996 | Birden | A45D 34/042 401/198 |
| 2006/0120795 | A1* | 6/2006 | Martzloff | B43K 1/12 401/235 |
| 2013/0170887 | A1* | 7/2013 | Gillum | B43K 8/12 401/143 |

* cited by examiner

*Primary Examiner* — Jennifer C Chiang
(74) *Attorney, Agent, or Firm* — Eversheds Sutherland (US) LLP

(57) ABSTRACT

Delivery systems for delivering compositions with large particles are disclosed herein. For example, writing instrument capable of delivering ink with large pigment particles can include a barrel, an ink reservoir in fluid communication with a nib, and one or more valves or seals for sealing the reservoir when not in use. For example, the writing instrument can include a free-ink reservoir having an agitator disposed on a valve stem.

20 Claims, 30 Drawing Sheets

INK DELIVERY SYSTEM

BACKGROUND

Field of the Disclosure

The disclosure generally relates to writing instruments for delivering ink composition having large pigment particles.

Brief Description of the Related Technology

Conventional writing instruments are typically designed for use with ink compositions containing relatively small pigment particles. They typically include a barrel or shell, an ink reservoir for containing the ink composition within the barrel, and a writing tip or nib in fluid communication with the ink reservoir to deliver the ink composition to a substrate. Some writing instruments, such as ball point pens, contain relatively non-volatile, high viscosity inks. Such conventional writing instruments are generally not capable of delivering inks having large pigment particles, as the particles would clog the ball point or other delivery system. Further, such conventional writing instruments do not generally have a sealing mechanism to seal the ink stored in the reservoir from environmental conditions when not in use because there is little to no concern that the non-volatile, high viscosity inks used with such instruments would evaporate under normal conditions.

Writing instruments designed for more volatile and less viscous inks, such as capillary-action markers, typically include a fibrous ink reservoir and a fibrous nib in fluid communication therewith. Such low-viscosity inks generally do not include pigment particles, much less large pigment particles because such particles tend to settle out and agglomerate within the reservoir, nib, or both, rendering the marker inoperable. Even if such pigment particles can be adequately suspended in the low-viscosity ink, such compositions cannot be suitably delivered by the marker, which becomes clogged (within the fibrous reservoir and/or the fibrous nib) by the particulate over time.

Valve action markers have been developed in attempt to deliver inks with large pigment particles. Valve action markers utilize a spring-loaded nib, which opens a valve to an ink reservoir when depressed in the axial direction (against a writing surface), thereby allowing the ink to flow from the ink reservoir to the nib. Such valve-action markers are problematic in that the pigment particles tend to settle to the bottom of the ink reservoir when the markers are not in use. Consumers must then violently shake the markers prior to use in order to redistribute the pigment particles throughout the ink composition to deliver the desired visual effect when the ink composition is transferred to the substrate. The consumer, however, has no means to verify that the pigment is sufficiently redistributed. Such valve action markers can also be disadvantageous or undesirable to users because they require the nib to be depressed and a force applied to the nib during writing to deliver the composition to the nib. Substantial depression, typically about 0.1 inches or more, of conventional valve-action markers is required to initiate flow of the ink and large axial movement must be repeated or maintained for good ink delivery. This can require users to utilize unnatural writing strokes, which can be displeasing and even fatiguing.

SUMMARY

In accordance with an embodiment of the disclosure, a writing instrument can include a barrel; an ink reservoir disposed within the barrel; a vane disposed within the ink reservoir; a writing nib in fluid communication with the ink reservoir; a valve comprising a first end and an oppositely disposed second end. The nib is coupled to the valve at the first end and the vane is coupled to the valve at the second end. The nib is adapted to actuate to shift the valve between first and second positions. When in a first position the valve is disposed in the barrel such that at least a surface of the valve seals against an internal surface of the barrel to prevent flow between the ink reservoir and the nib. When in a second position, the valve is shifted to open one or more passages through which a fluid can flow from the ink reservoir to the nib.

In accordance with an embodiment of the disclosure, a writing instrument can include a barrel; a collapsible ink reservoir disposed within the barrel; a nib in fluid communication with the ink reservoir; and a tensator spring coupled to the collapsible ink reservoir, wherein an end of the tensator spring is fixed to the barrel near the nib and the tensator spring comprises a coil disposed opposite the fixed end, with the coil being adjacent to and optionally coupled to an end of the ink reservoir. When the ink is removed from the reservoir, the tensator spring tightens, moving the coil towards the fixed end, which in turn at least partially collapses the ink reservoir.

In accordance with an embodiment of the disclosure, a writing instrument can include a barrel; an ink reservoir defined within the barrel, wherein the ink reservoir is pressurized; a nib in fluid communication with the ink reservoir; a valve coupled to the nib. The nib actuates to shift the valve between first and second positions, and when in a first position the valve prevents fluid flow between the ink reservoir and the nib and when in the second position a passage is provided to allow flow between the ink reservoir and the nib. The ink reservoir can be pressurized by a gas directly in contact with a fluid disposed in the reservoir and/or by a piston, for example, a spring actuated piston.

In accordance with an embodiment of the disclosure, a baffled nib can include a first layer comprising one or more first layer holes a second layer disposed adjacent to the first layer and comprising one of more second layer holes, the second layer holes being offset from the first layer holes; and one or more spacers disposed between the first and second layers, wherein a flow channel is defined between the first and second layers.

In accordance with an embodiment of the disclosure, a writing instrument can include the baffled nib. The writing instrument can include a covering disposed over the baffled nib. For example, a porous material can be disposed over the baffled nib to deliver ink from the baffled nib to the substrate.

DETAILED DESCRIPTION

Figure 1:
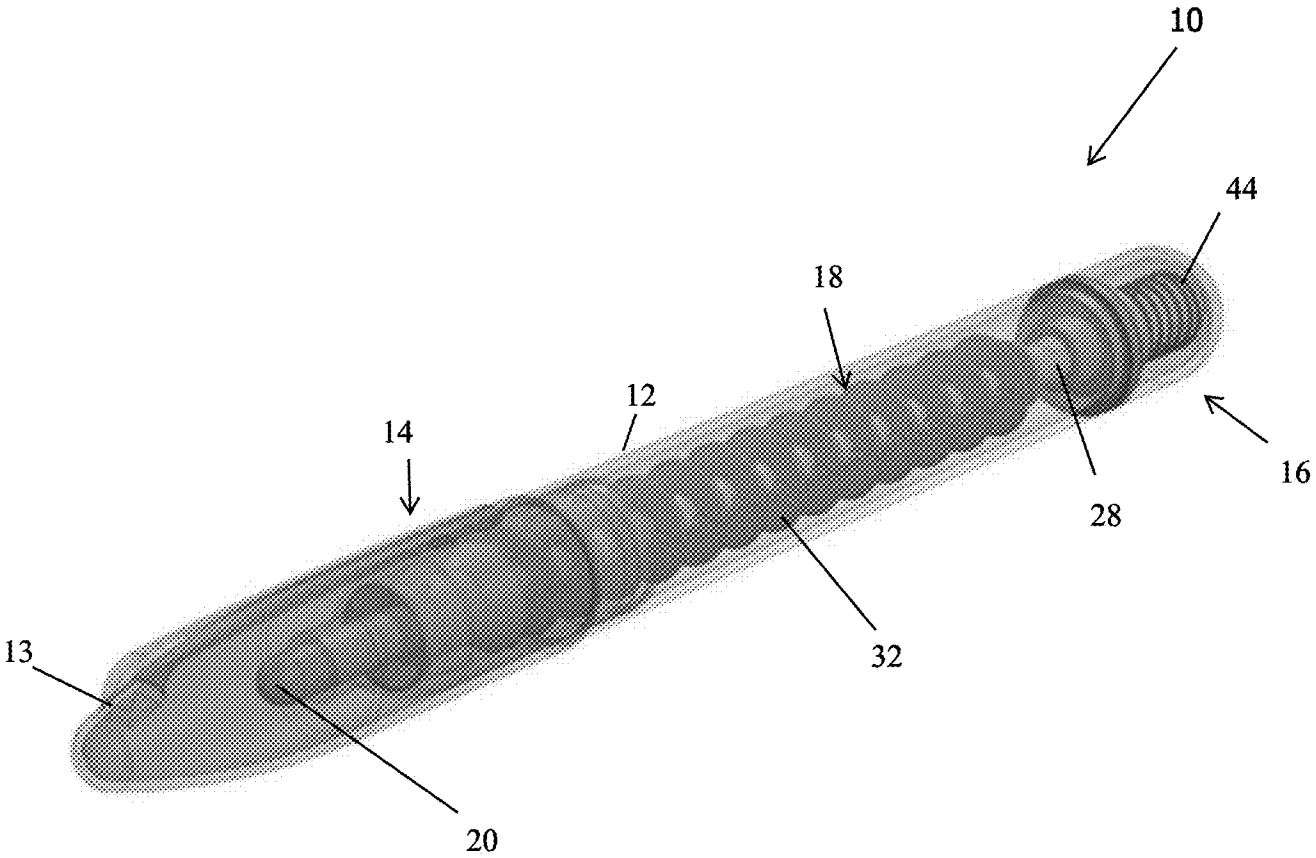
FIG. 1 is a perspective view of a writing instrument in accordance with an embodiment of the disclosure.

Disclosed herein are delivery systems capable of delivering compositions with large particles to a substrate. For example, the delivery system can be a writing instrument for delivering inks with large pigment particles to a substrate. Pigment particles having a diameter of greater than 8 microns are generally considered large and are not compatible with conventional writing instruments. In accordance with embodiments of the disclosure, a writing instrument can deliver large pigment particle containing inks without requiring priming and/or re-priming as required by conventional valve-action markers. The writing instruments in accordance with embodiments of the disclosure can deliver a variety of types of inks containing large pigment particles, including volatile inks, non-volatile inks, thixotropic inks, yield stress inks, non-Newtonian inks, and Newtonian inks.

Embodiments of delivery systems in accordance with the disclosure include a barrel 12 having a front end 14 and an oppositely disposed rear end 16, an ink reservoir 18 disposed within or formed within the barrel 12, and a nib 20 in fluid communication with the ink reservoir 18. One or more valves or seals can be included in the delivery system to seal the ink reservoir when the system is not in use. For example, a valve or seal 24 can be attached to the nib 20 and actuatable by depression of the nib 20 to open the valve 24 and allow fluid communication between the ink reservoir 18 and the nib 20. Writing instruments in accordance with the drawings can also include a cap 13 for covering the nib 20 when not in use.

Figure 25:
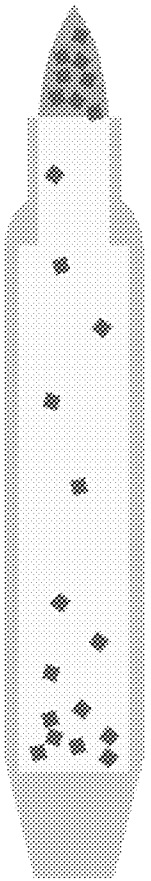
FIG. 25 is a schematic drawing of a writing instrument having a nib in accordance with an embodiment of the disclosure, which can prevent pigment drain-back.
Figure 24:
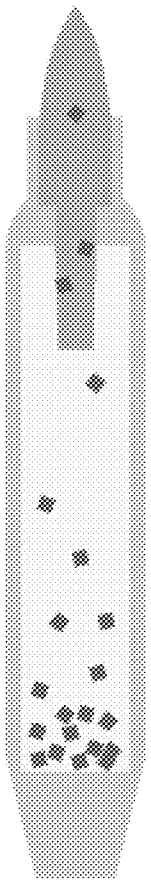
FIG. 24 is a schematic drawing of a conventional writing instrument illustrating pigment drain-back.

Conventional writing instruments when utilized with large-pigment containing inks can suffer from pigment drain-back. Referring to FIG. 25, pigment drain-back can occur when a writing instrument 10 is stored tip-up. In such an orientation, the pigment can drain back away from the nib. This can disrupt the delivery of the pigment from the writing instrument, which can provide a poor writing experience. In several of the embodiments disclosed here, the writing instruments reduce or prevent pigment drain-back to improve the usability of the instrument.

For delivery systems to be used as writing instruments, it has been observed that a writing instrument will leave behind a surface film thickness of about a·10 microns, where a is about 1. Assuming this is absorbed into the substrate over n seconds after deposition, the following relationship is found assuming negligible ink absorption before film laydown:

$$a \cdot 10^{-5} \approx \sqrt{\frac{2\varepsilon\kappa Pn}{\mu}},$$

Where κ is the permeability of the substrate, ε is the porosity of the substrate, and P is the capillary draw force into the substrate. Assuming, for example, κ is about $10^{-14}$ and P is about $10^4$ Pa ($P \approx 2\gamma/R_{fiber}$), then this reduces to:

$$\mu \leq 2\varepsilon n/a^2 \sim O(1)$$

From this, it can be concluded in some instances that a delivery system writing on paper should have a maximum viscosity of about 0.1 to 1 Pa·s to avoid smearing. This can allow slow settling, but not effectively cease settling for the writing instrument lifetime, which has been observed to require tens to hundreds of Pa·s.

This can also be true in some instances for writing on non-absorbent surfaces. For example, stable coating flows require capillary numbers less than unity, i.e.:

$$Ca_n = \sqrt{\frac{\mu V}{\gamma}} \leq 1$$

For typical writing speeds (V~2 inches/second or 0.05 m/s) and ink surface energies (γ~30 mN/m), it can be seen that μ≤0.6 Pa·s. This does not exclude the use of higher viscosities in an instrument in accordance with the disclosure. Coating operations can be successfully carried out at $Ca_n >> 1$. However, other factors in the system beside capillary pressure may dominate film laydown under these circumstances. For example, fine details of a nib shape can be a factor.

In accordance with some embodiments, the writing instrument can result in high driving pressure. For example, in embodiments in which the writing instrument is spring or air pressure driven, pressure in excess of $10^4$ Pa can be generated. In such embodiments, it can be useful to utilize non-fibrous nibs. For example, a pipe-type or syringe style nib may be beneficial for such embodiments. For fibrous nibs used in such embodiment, fine fiber diameters may be needed in some embodiments to generate enough resistance to flow. An exemplary calculation of suitable fiber diameter for a high driving pressure instrument is illustrated below:

$$Q \approx \Delta P_{drive}/(Z_{nib}\mu)$$

$$(Z_{nib}\mu) \sim 10^4 \text{ Pa}/10^{-9} \text{ m}^3 \text{ s}^{-1} \sim O(10^{13})$$

$$\mu \sim O(10^{-2}-1)\text{Pa·s} \rightarrow Z_{nib} \sim O(10^{13-15})\text{m}^{-3}$$

$$Z_{nib} \approx L_{nib}/(A_{nib} f D^2) \sim 10^{-2}\text{m}/(10^{-4} \text{ m}^2 \cdot 10^{-2} D^2)$$

$$\rightarrow D \approx (3\text{-}30) \ \mu\text{m},$$

Where Z is the fluid resistance, D is the fiber diameter

Large pigment particles can be delivered through fibers having diameters at the large end of this range (30 μm), but smaller diameters of about 3 μm can become clogged by pigment particles. For example, with a fiber having a diameter of about 30 μm, inks having pigment particles of less than about 10 microns can generally be accommodated. In embodiments with high driving pressure where it is desired to use a fibrous nib, fiber diameter requirements can be increased some by utilizing longer and/or more porous nibs. The fiber diameter must be sufficiently large to accommodate passing of the pigment particle size and thus selection of suitable fiber diameter will depend not only on the needs for generating sufficient resistance to flow, but also on the selection of ink to be utilized in the instrument.

In some embodiments, a pipe or syringe type nib can be used. The pipe or syringe can have a small cross-sectional area in some embodiments. For example, $$Z_{pipe} = 128 \ L/(\pi D^4) \sim 10^{(13\text{-}15)} \text{ m}^{-3}$$

$$L \sim O(10^{-2} \text{ m}) \rightarrow D \approx (130\text{-}420) \ \mu\text{m}$$

Particles of several tens of microns in diameter could be passed through a pipe or syringe even at the low end (130 μm) of the exemplified calculation. Such diameters can be manufactured in metal structures and may be manufactured by extrusion techniques. Such diameters correspond to syringes having a gauge range of about 22 to about 31.

In yet another embodiment, a nib can be manufactured in a pipe-like structure using a bundle of fibers. The fibers can be bundled for example as illustrated in in FIG. 31, resulting in a gap between the fibers. The gap can provide the opening through which larger pigment particles can flow. For example, the fibers can have 100 μm to millimeter diameters. The size of the gap correlates to the diameter of the fiber according to $D_{gap} \approx 0.2 \ D_{fiber}$.

In various embodiments, the instrument can be used with a yield stress ink. Yield stress inks can aid in reducing the settling of the pigment particles during storage. For flow of a yield stress ink to take place, the driving pressure must be greater than the yield stress as distributed over the dispenser (e.g., nib) wall. For example:

$$\Delta P \geq \frac{2L\tau_y}{r}$$

For a fibrous nib, for example, L can be about 0.01 m and r about 20 microns, which leaves a $P \geq 1000 \ \tau_y$, which implies a net drive pressure of about $10^4$ Pa would need τ≤10 Pa. Accordingly, with at least some yield stress ink, a fibrous nib can be on the verge of clogging at such yield stress.

Using a pipe or syringe type nib, however, can accommodate the higher yield stress. For example, in an exemplary pipe-type nib, L can be about 0.01 m, r about 130-400 microns. In such an embodiment, the device could push inks with yield stresses up to 70 to 200 Pa for a drive pressure of $10^4$ Pa.

Figure 15:
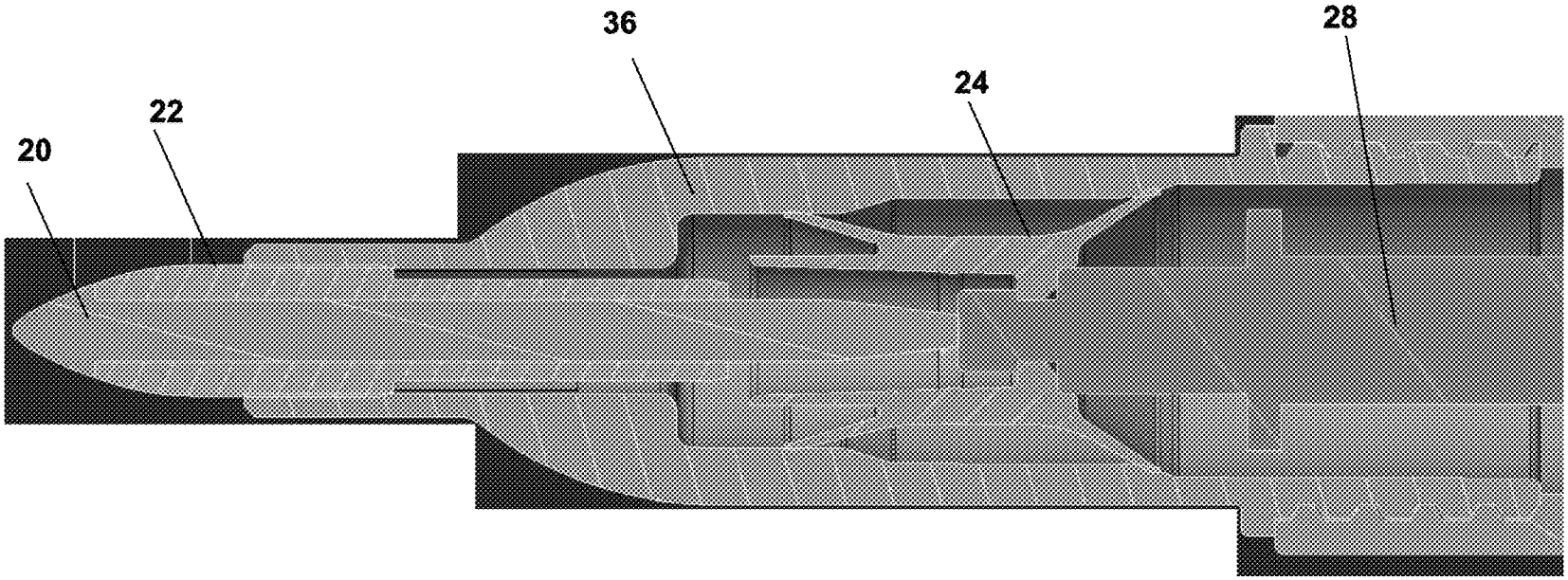
FIG. 15 is a cross-sectional view of a front end of a writing instrument illustrating a nib in accordance with an embodiment of the disclosure.

Any type of nib can be used in any of the embodiments disclosed herein. For example, the nib can be fibrous or non-fibrous. For example, the nib can be porous, such as a porous plastic nib. For example, the nib can be non-porous, such as a metallic nib. In various embodiments, the nib 20 can be an acrylic linear fiber nib. Referring to FIG. 15, a nib 20 can include a nib adapter 22 that is fitted around a circumference of the nib 20 along a portion of the length of the nib 20 in order to stiffen the nib 20. In various embodiments, the nib 20 and the adapter 22 can be coextruded. In other embodiments, the adapter 22 can be attached to the nib 20 using any known methods including heat sealing, ultrasonic sealing, press fitting, and adhesives. The adapter 22 can be formed of any suitable material for improving the rigidity of the nib 20. For example, the adapter 22 can be a plastic adapter. Suitable materials, include for example, polypropylene, polyethylene, polyethylene terephthalate, polyacetal copolymer, and combinations thereof. For example, in an embodiment, the adapter is a polyacetal homopolymer coextruded with a polyacetal copolymer that forms the inner nib.

In any of the embodiments disclosed herein, the delivery systems can include one or more of venting systems, caps or covers, additional body structures, gripping portions, or any additional structures used with delivery systems. In any of the embodiments disclosed herein, one or more of the ink reservoir, a vent, a valve, and a nib can be disposed in the body. The body can be a unitary piece or provided as multiple portions. For example, the body can include two portions that are attached to each other. A first body portion can include the ink reservoir disposed therein, while the second body portion can receive the nib and a valve or seal, coupled to the nib. For example, the first body portion can be a barrel 12 and the second body portion can be a nib ferrule 36.

In any of the foregoing embodiments, a valve or seal can be disposed adjacent to and/or attached to the nib. The valve or seal can include a sealing portion that engages an internal surface of the barrel or ferrule to seal between and prevent fluid communication between the reservoir and the nib. The nib can be displaceable by application of a lateral force, for example, by pressing the nib against a substrate, which in turn can actuate the valve or seal to shift the valve or seal from a first (closed) position, in which ink is prevented from flowing from the ink reservoir to the nib, to a second (open) position in which a passage is provided to allow ink to flow from the ink reservoir to the nib. In some aspects, the internal surface of the barrel or ferrule can be tapered or otherwise contoured such that when the valve or seal is in the first position, the internal surface of the barrel or ferrule is engaged by the valve or seal, and when the valve or seal is actuated to the second position, the barrel or ferrule is tapered in that region away from the edge of the seal such that passage exists between the valve or seal and the internal barrel or ferrule surface. For example, the barrel or ferrule can include a first region having a first cross-sectional diameter and a second region having a second cross-section diameter greater than the first cross-sectional diameter and the valve can be disposed in the first region when in the first position and in the second region when in the second position. The valve can be sized such that at least one surface, for example, a conically shaped projection, engages the internal surface of the barrel or ferrule in the first region to seal against the barrel or ferrule and prevent flow of ink from the ink reservoir to the nib. The second cross sectional diameter can be selected such that the at least one surface is no longer able to engage the internal surface of the barrel or ferrule and passage is provided for flow of the ink. Other valve structures, which may not engage an internal surface of the barrel or ferrule, but some other structure such as a valve seal can also be used. For example, a ball valve can be used in any of the embodiments disclosed herein.

The delivery system can be in some embodiments a writing instrument, such as a pens, markers, and glitter or particle dispensing instruments. In other embodiments, the delivery system can be used in cosmetic tools, such as liners and other make-up applicators. In other embodiments, the delivery system can be used with electronics, for example, to deliver metallic particles, for example, for soldering, or deliver conductive particles, for example, for drawing circuits. In yet further embodiments, the delivery system can be used in the paint industry to delivery paints with pigment particles. While embodiments are discussed herein with respect to a writing instrument and delivery of inks, it should be understood that such embodiments can be suitable for alternative applications and delivery of other particle containing compositions such as described above.

Free-Ink Reservoir

Figure 3:
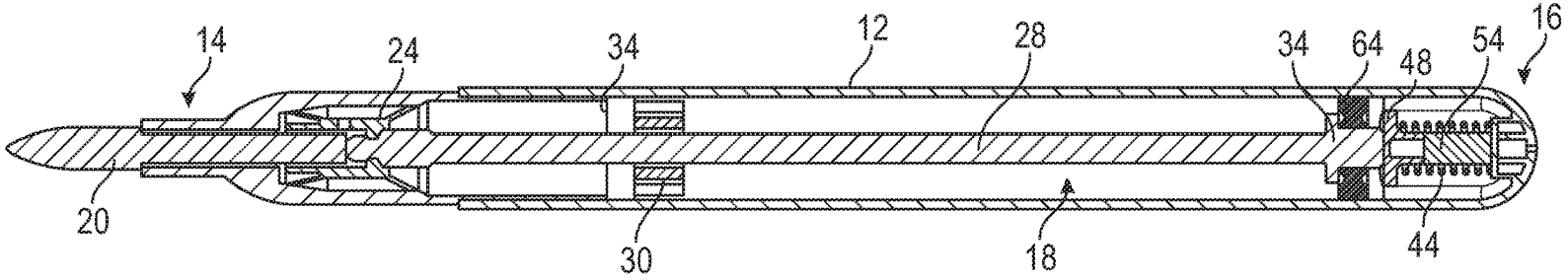
FIG. 3 is a cross-sectional view of a writing instrument in accordance with an embodiment of the disclosure.

Referring to FIGS. 1 and 3, in accordance with an embodiment a writing instrument 10 can include a free-ink reservoir 18. For example, a free-ink reservoir 18 can be disposed within the barrel 12 of the writing instrument 10. Alternatively, the barrel 12 or a portion thereof can define an external wall of the ink reservoir 18. The free-ink reservoir 18 can be free of or substantially free of a fibrous fill. The writing instrument 10 further includes a nib 20 in fluid communication with the ink reservoir 18 and a valve 24 for opening the fluid connection between the ink reservoir 18 and the nib 20 during use. The writing instrument 10 can include a valve stem 28 disposed in the barrel 12 and connected to the valve 24 to actuate the valve 24 between the open and closed position. In various embodiments, as illustrated in FIGS. 1 and 3, the valve stem 28 can be disposed in the free-ink reservoir.

The nib 20 and the valve can be housed within the body. In some embodiments, the body can include multiple portions as shown in FIG. 1, with a barrel 12 defining the ink reservoir and a ferrule 36 (in a gripping region 26 of the writing instrument 10) that receives a portion of the nib 20 and the valve 24. The barrel 12 and the ferrule 36 can be attached to each other. For example, the barrel 12 and the ferrule 36 can be permanently attached to each other. Alternatively, the barrel 12 and the ferrule 36 can be removably attached to each other.

As described above, the nib 20 can be a fibrous nib, a non-fibrous nib, a porous nib, a non-porous nib, and/or a nib having an adapter. The nib 20 can be a loose nib in some embodiments. The nib 20 can also be widened in various embodiments, which can aid in reducing clogging by larger pigment particles during use. For example, in an embodiment, the nib 20 is a non-fibrous nib having an aperture disposed there-through to allow flow of the ink through the nib 20. The nib 20 can be provided with or without an adapter 22 as described above.

Figure 2:
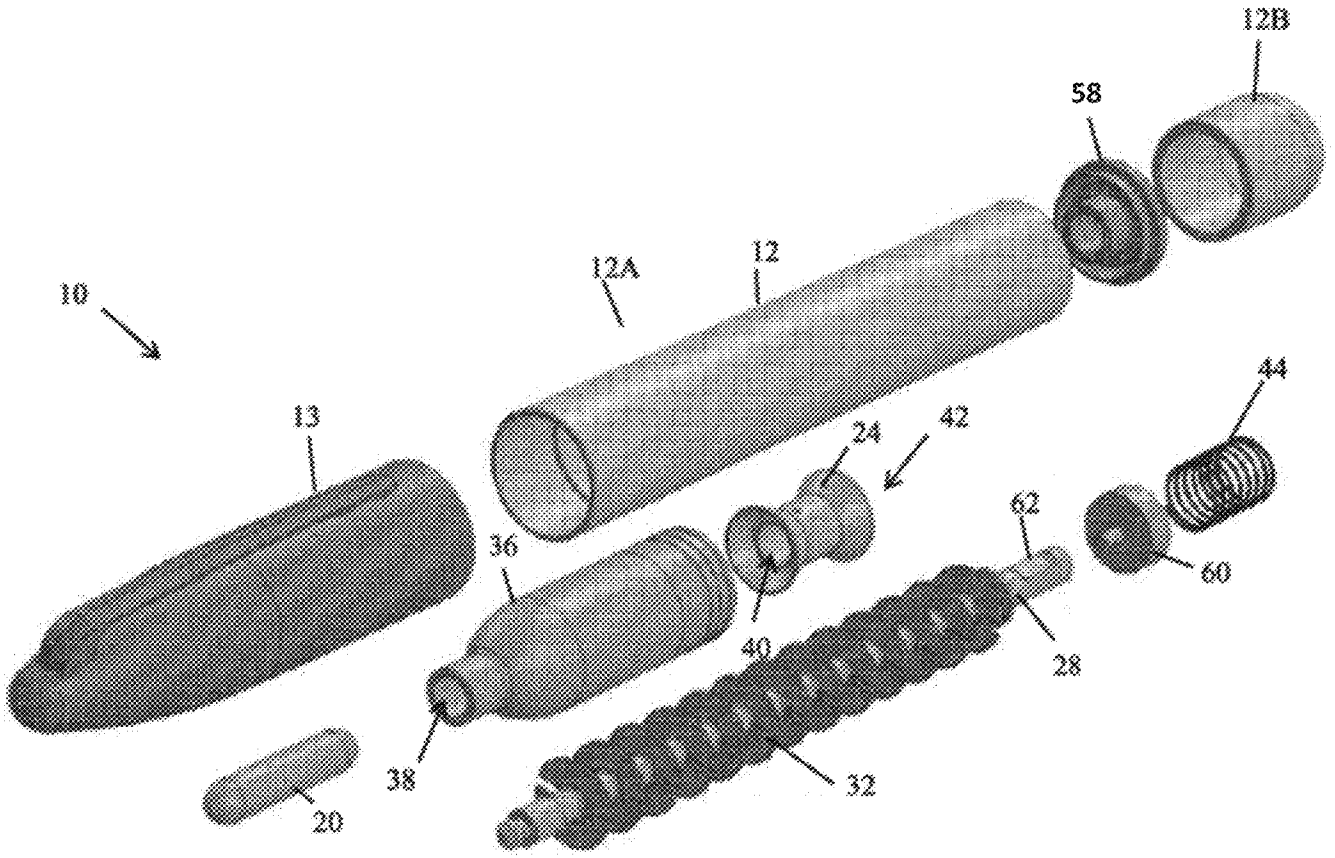
FIG. 2 is an exploded view of the writing instrument of FIG. 1.

Referring to FIGS. 2 and 3, the writing instrument can further include an agitator 30 disposed on or about the valve stem 28 that is received in the ink reservoir 18. The agitator 30 can aid in improving airflow within the ink reservoir, as well as, agitate the ink to the prevent or reduce pigment settling.

FIG. 2 illustrates an embodiment in which the agitator 30 is a vane 32 disposed around the valve stem 28. As illustrated in FIG. 2, the vane can be provided as an integral structure with the valve stem 28. It is also contemplated herein that the vane 32 can be a separate structure from the valve stem 28. For example the vane 32 can include an aperture for receiving the valve stem 28.

Figure 4:
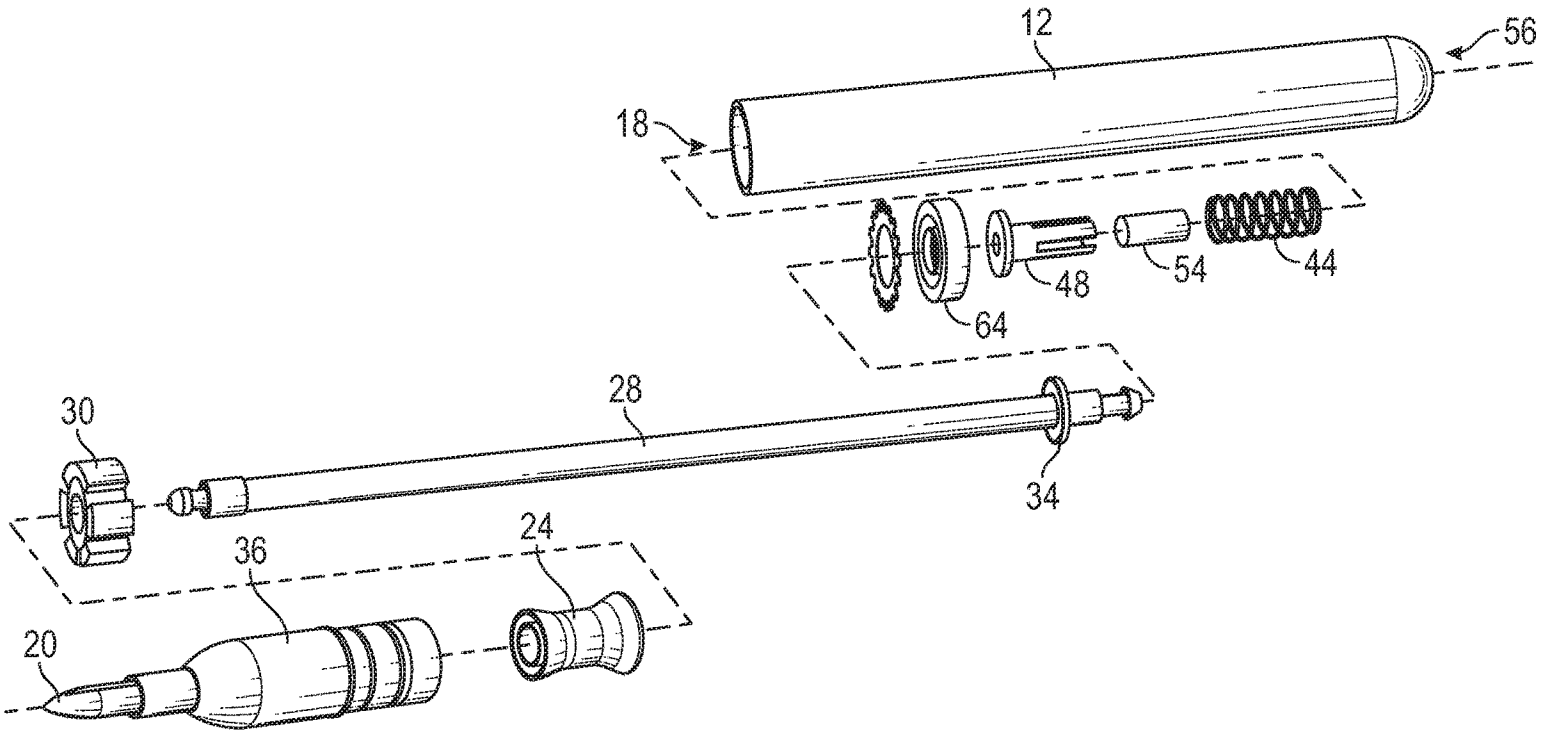
FIG. 4 is an exploded view of the writing instrument of FIG. 3.
Figure 7:
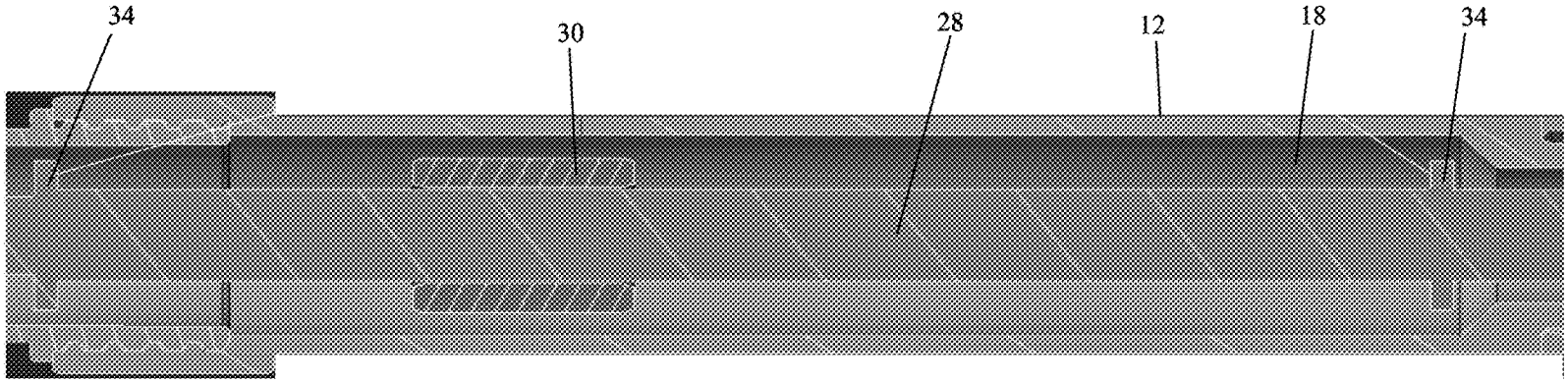
FIG. 7, is a schematic illustration of an agitator in accordance with an embodiment of the disclosure.

FIG. 3 illustrates and embodiment in which the agitator 30 is a structure that is movable along the valve stem 28. As the writing instrument 10 is moved from tip down to tip up orientations, the agitator 30 moves along the valve stem 28 to agitate the ink. The agitator 30 can also be received on the valve stem 28 such that it is capable of rotating as well as traveling in a linear direction along the length of the valve stem 28. The writing instrument 10 can include stops 34 positioned within the ink reservoir 18, such that the agitator 30 travels between an opposed pair of stops 34. The stops 34 can be provided by structures within or adjacent to the reservoir 18. Referring to FIG. 7, for example, the stops 34 can be provided on the valve stem 28. In another embodiment, as illustrated in FIG. 3, the front stop 34 can be provided by an edge of a nib ferrule 36 that receives nib 20 and valve 24. FIG. 4 illustrates an exploded view of a writing instrument having an agitator 30 that is received on an movable along a valve stem 28. During assembly of the writing instrument, the agitator 30 can be positioned at the rear end of the valve stem 28 to facilitate assembly. The agitator 30 is fitted on to the valve stem 28 such that it is capable of sliding along the valve stem after assembly is completed and in response to movement of the orientation of the writing instrument. In various embodiments, the agitator 30 can be formed from a metal. For example, the agitator 30 can be formed of stainless steel or aluminum.

In various embodiments, the writing instrument includes a valve 24 in the front end 14 to seal the fluid connection between the nib 20 and the ink reservoir 18 when the writing instrument 10 is not in use. This can aid in prevent evaporation of the ink in the reservoir, for example, when volatile inks are used. For example, the valve can be a PE valve. In some embodiments, the writing instrument can experience solvent drain back, particularly where a loose nib is utilized. The solvent can be drained back to the valve structure, which can include a small reservoir and/or an absorbent structure to contain such drain back. The valve can also function to provide a reservoir of ink when writing in a tip-up configuration where the orientation of the writing instrument results in a gravitation force that impedes flow of the ink to the nib.

In a tip-down configuration, the pressure driving flow of the ink to the nib can be mainly gravity and tip capillary draw. For example, flow can be initiated by pressures of about 100 to 1000 Pa.

Figure 8:
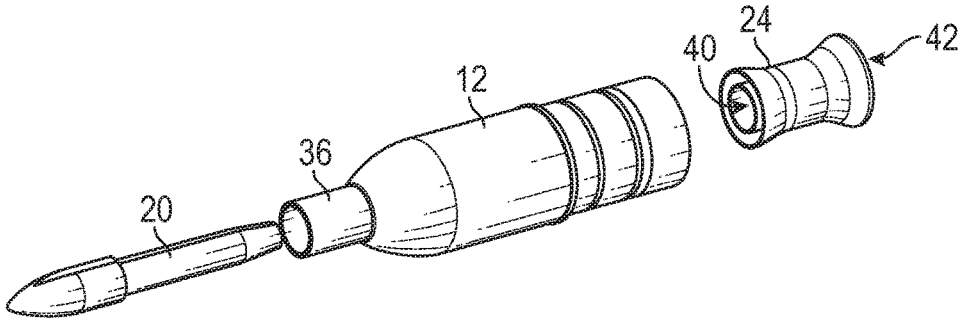
FIG. 8 is an exploded view of a front end of a writing instrument in accordance with an embodiment of the disclosure.
Figure 9:
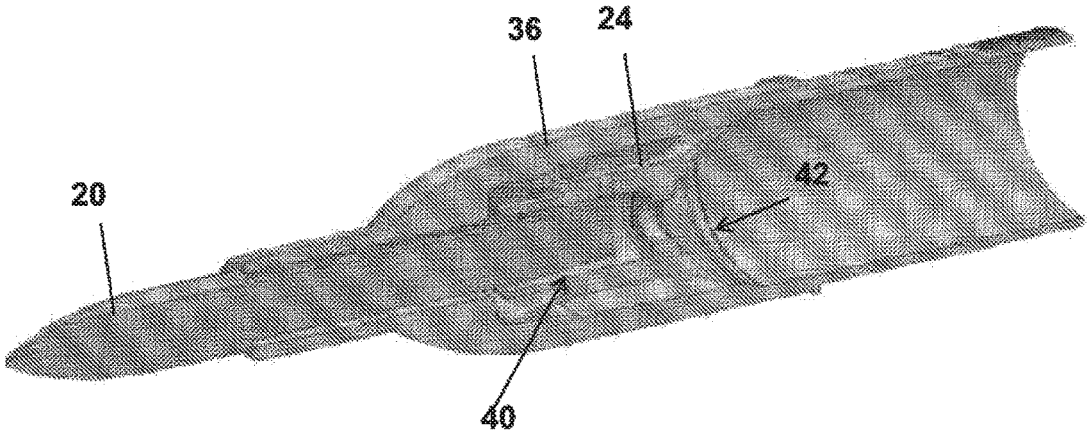
FIG. 9 is a cross-sectional view of the front end of the writing instrument of FIG. 8.
Figure 10A:
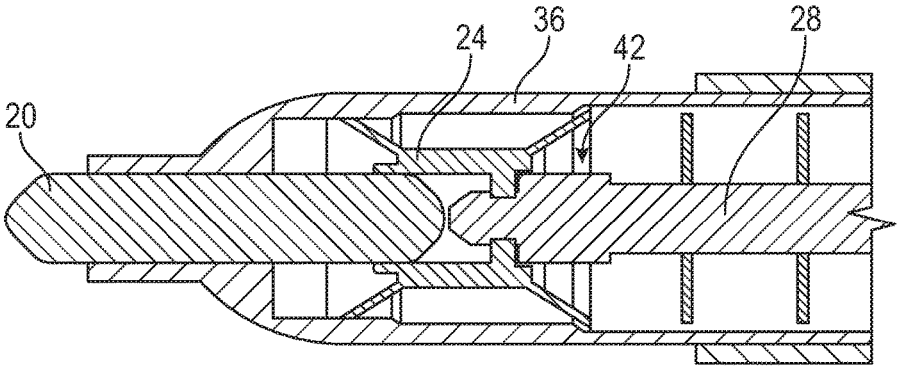
FIG. 10A is a cross-sectional view of a front end of the writing instrument of in accordance with an embodiment of the disclosure, showing the nib and a valve in the in-use position.
Figure 10B:
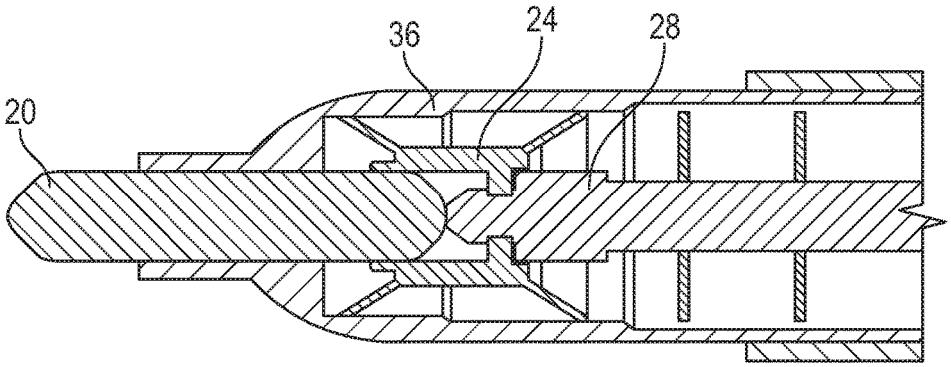
FIG. 10B is a cross-section view of a front end of the writing instrument in accordance with an embodiment of the disclosure, showing the nib and valve in the storage position.

Referring to FIG. 8, in various embodiments, the nib 20 and the valve 24 can be housed in a nib ferrule 36 that is attached to the barrel 12. FIG. 9 is a cross-sectional view of the exploded assembly of FIG. 8. As illustrated in FIG. 9, the nib 20 is received in a front opening 38 of the nib ferrule 36 and engages with an opening 40 of the valve 24. As illustrated in FIGS. 10A and 10B, the valve stem is then received in an opposed rear opening 42 of the valve 24 such that it is in contact with the valve stem 28.

Referring to FIG. 10, valve 24 can seal against one or more internal walls of the barrel or the nib ferrule 36 (if present) when the writing instrument is not in use to prevent flow of the ink to the nib. FIG. 10 illustrates an embodiment in which the writing instrument 10 includes a nib ferrule 36. The nib 20, which is in contact with the valve stem also seated in the valve 24, is attached to the valve 24, such that the valve 24 can be displaced in at least one direction by depression of the nib 20 against a substrate. The movement of the nib 20 functions to unseat the valve from the wall of the ferrule 36 (or barrel 12) and allow flow of the ink to the nib 20. As illustrated in FIGS. 10A and 10B, in various embodiments, the internal surface of the nib ferrule 36 can include a taper or other widened region such that when in the first position (FIG. 10B), a surface of the valve 24 engages the internal surface of the nib ferrule 36, forming a seal to prevent fluid communication between the nib 20 and the ink reservoir 18, and when in the second position (FIG. 10A), the valve 24 is shifted to a position where the internal surface is tapered away from the valve 24 (or otherwise widened) such that the valve 24 surface cannot not engage the internal surface of the nib ferrule and a passage for flow of ink is provided. Referring to FIG. 10A, when in use, the nib 20 can be depressed and moved axially toward the interior of the writing instrument 10. This can displace the valve 24 towards the ink reservoir 18, opening a passage between the nib 20 and the reservoir 18 to allow for flow of the ink from the reservoir 18 to the nib 20.

In various embodiments, the valve can include a nib receiving area for receiving an end of the nib in a central region of the valve and one or more sealing portions that extend to contact the internal surface of the barrel when in the sealed position. In some embodiments, the sealing portions can be one or more conical portions extending outwardly from an end (or ends) of the valve. In some embodiments, conical portions can extend outwardly from opposed ends of the valve, surrounding a portion of the nib at one end. One or both of the conical portions can have an open internal volume, which can provide internal reservoirs within the valve that can catch solvent drain back and/or allow for some ink to be retained in the valve to provide for ink flow when writing in a tip-up configuration.

Figure 11A:
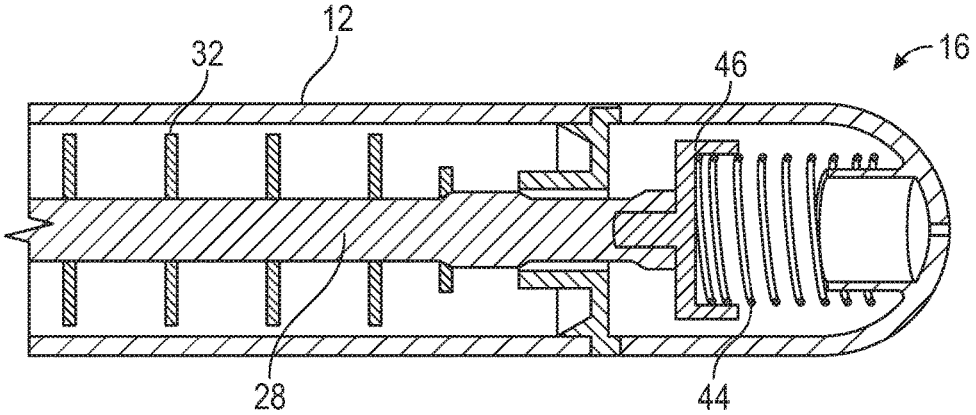
FIG. 11A is a cross-sectional view of a rear end of the writing instrument of in accordance with an embodiment of the disclosure, showing a vent in the in-use position.
Figure 11B:
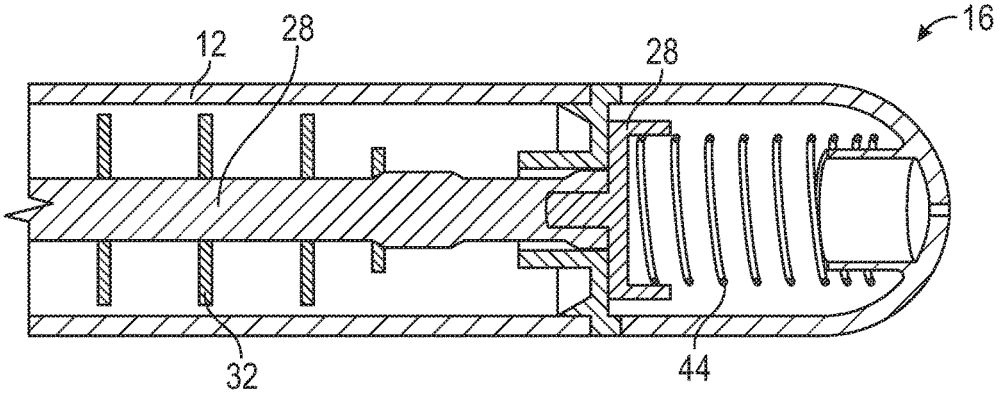
FIG. 11B is a cross-sectional view of a rear end of the writing instrument in accordance with an embodiment of the disclosure, showing the vent in the storage position.

Referring to FIGS. 11A and 11B, the writing instrument 10 can further include a spring 44 disposed at or connected to a rear end of the valve stem 28. The spring 44 biases the valve stem 28 and consequently the valve 24 to the closed position when the writing instrument is not in use. When the nib 20 is engaged with a writing surface, the force of the nib 20 against the writing surface forces the valve 24 and the valve stem 28 towards the spring 44, compressing the spring 44 while unseating the valve 24 from the ferrule 36 or barrel 12 sealing surface. FIGS. 11A and 11B illustrate an embodiment in which the spring 44 is received on a spring holder 46, which in turn is coupled to the valve stem 28. The spring 44 is fixed at the rear end of the barrel, opposite to the end of the spring received at the spring holder 46.

Referring to FIG. 4, in an embodiment, the spring 44 can be received on a stem clip 48 that includes an opening for receiving an end portion of the valve stem 28 to couple the valve stem 28 and the stem clip 48. The stem clip 48 can include a cylindrical extension 50 over which the spring 44 is received.

Figure 5A:
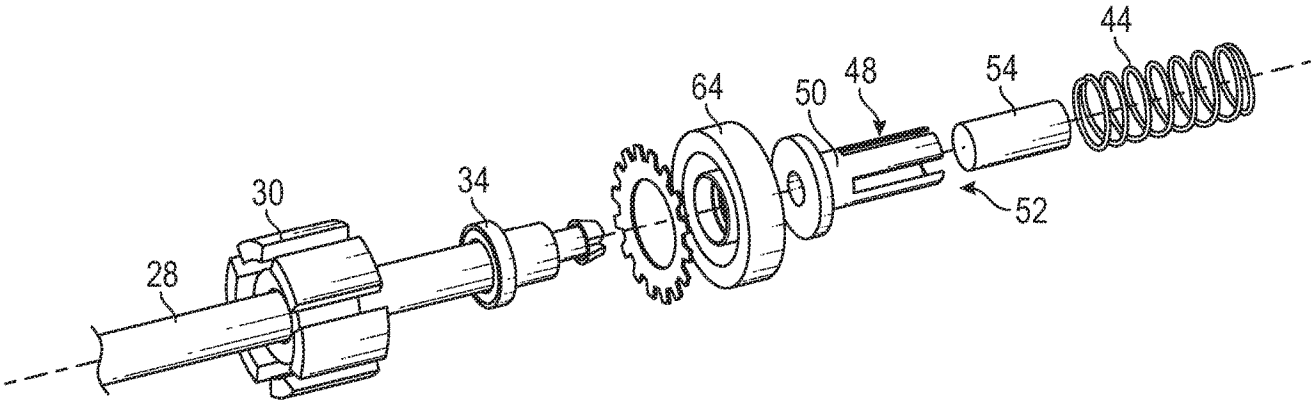
FIG. 5A is an exploded view of the rear valve stem assembly of the writing instrument of FIG. 3.
Figure 5B:
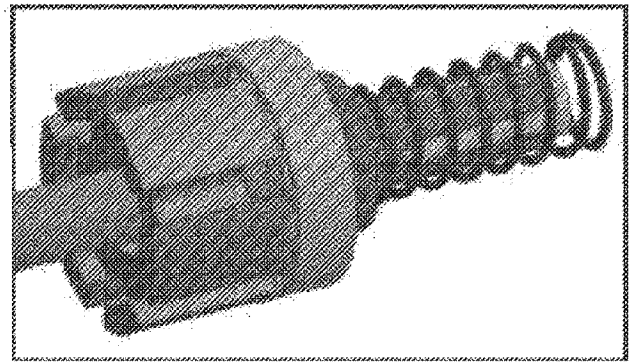
FIG. 5B is an assembled view of the rear valve stem assembly of FIG. 5B.
Figure 6A:
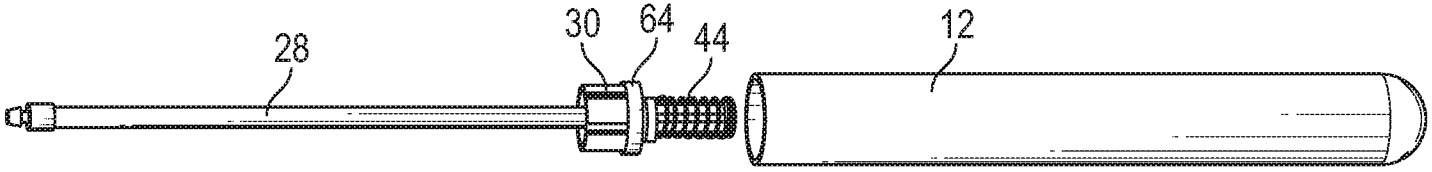
FIGS. 6A-6D are schematic illustrations of assembly of the writing instrument of FIG. 3.
Figure 6B:
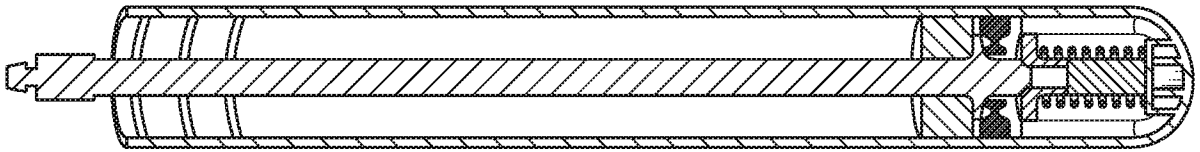
Figure 6C:
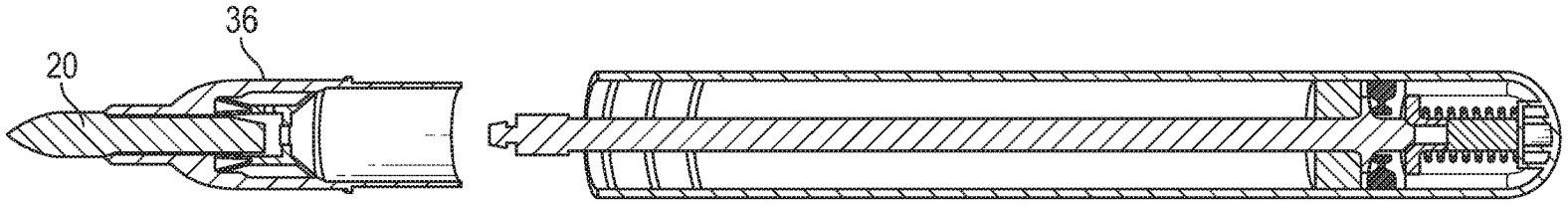
Figure 6D:
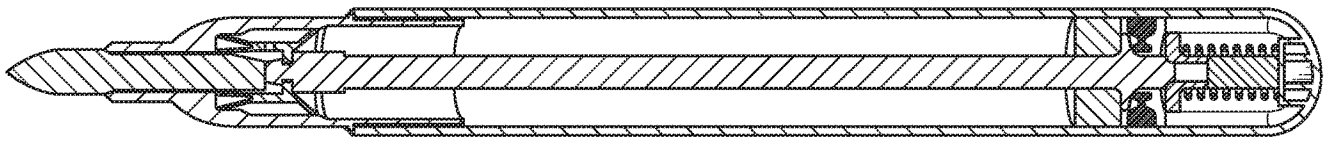

Referring to FIG. 5, the cylindrical extension 50 of the stem clip 48 can include an opening 52 for receiving a collector 54. The collector 54 absorbs or adsorbs ink that leaks from the ink reservoir 18 into the rear end of the barrel to prevent ink from leaking out of a vent hole 56 disposed in the rear end 16 of the barrel. The collector 54 can be formed of any suitable material, including, for example, polyester fiber.

In various embodiments, the writing instrument can include a vent structure. The vent structure can include a vent hole 56 in a rear end of the writing instrument, for example, in a rear end of the barrel 12. Actuation of the valve 24 and corresponding movement of the valve stem 28 can be used to open and seal the vent.

Referring to FIG. 2, the valve stem 28 can be connected to a vent, for example, an airlock structure, which can be engaged when the valve stem 28 is actuated by the valve 28, thereby allowing venting when the valve 24 is opened. Referring to FIG. 4B, when the writing instrument is not in use, the vent can be sealed to maintain the reservoir in a sealed state—being sealed at one end by the valve and at the opposed end by the vent or a portion of the vent. Referring to FIG. 4A, when the writing instrument is in use and the nib is depressed, the valve is opened to allow flow of the ink to the nib and the vent is opened to allow venting of the system at the opposed end of the reservoir. The use of a vent in the end of the writing instrument opposite the nib (rear end) can allow the systems to be primed without or at least with reduced need to pump the system.

Referring still to FIG. 2, in various embodiments, the airlock vent can include a first vent structure 58 having an aperture for receiving an end of the valve stem 28 and a second vent structure 60 that attaches to a notch 62 in the valve stem 28. The first and second vent structures 58, 60 are coupled to the valve stem 28, such that the vent is opened by actuation of the nib 20, as shown in FIGS. 4A and 4B. In the closed or stored position, the second vent structure 60 can be disposed against the first vent structure 58, preventing flow of gas through the vent. In the open or in use position, the second vent structure 60 can be displaced away from the first vent structure 58 such that at least one passage is exposed to allow gas to pass through. The spring 44 biases the vent structure in the closed position when the writing instrument is being stored and no force is applied to the nib 20.

Figure 12A:
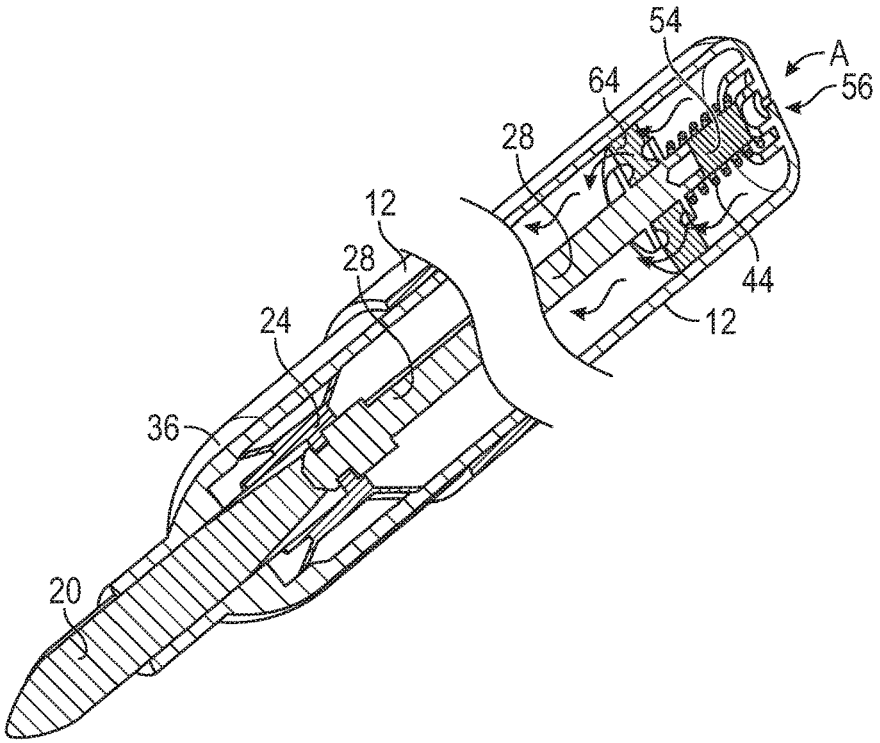
FIGS. 12A and 12B are a cross-sectional views illustrating air and ink flow through the writing instrument of FIG. 3.
Figure 12B:
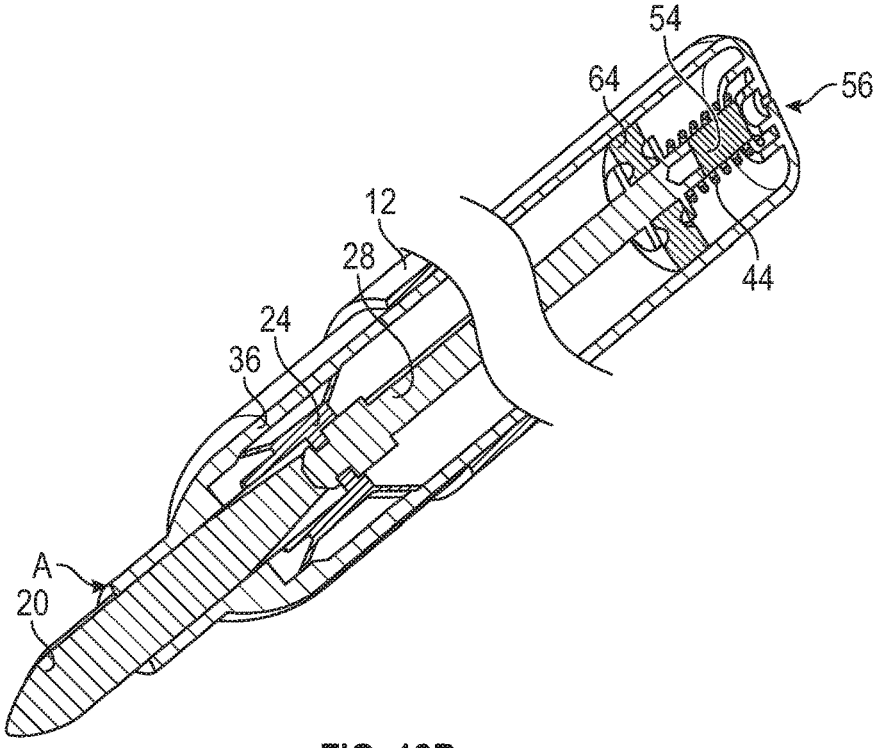

Referring to FIG. 5, the vent can alternatively be provided as a burp valve 64. During actuation of the valve 24 by pressing of the nib 20 against a writing surface, the burp valve 64 can open to allow air to flow into the ink reservoir, but close once the valve at the nib end is actuated to fully open to start the flow of ink to the nib 20. FIGS. 12A and 12B illustrate the actuation of the burp valve 64 during opening of the valve 24 at the nib 20. [

Figure 13A:
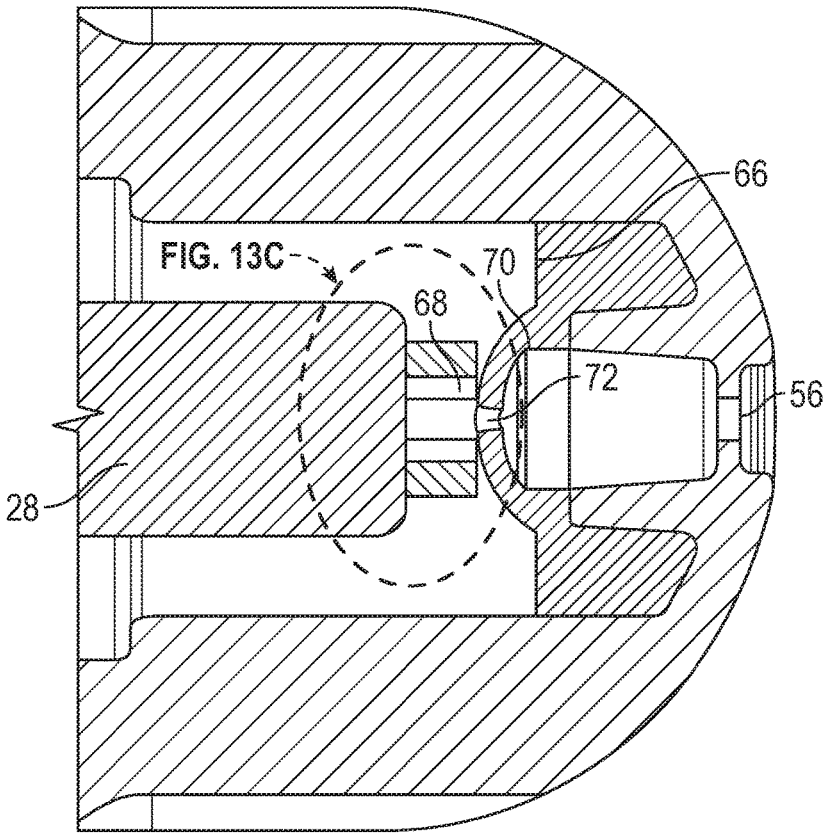
FIG. 13A is a cross-sectional view of a rear end of a writing instrument illustrating a vent structure in accordance with an embodiment of the disclosure.
Figure 13B:
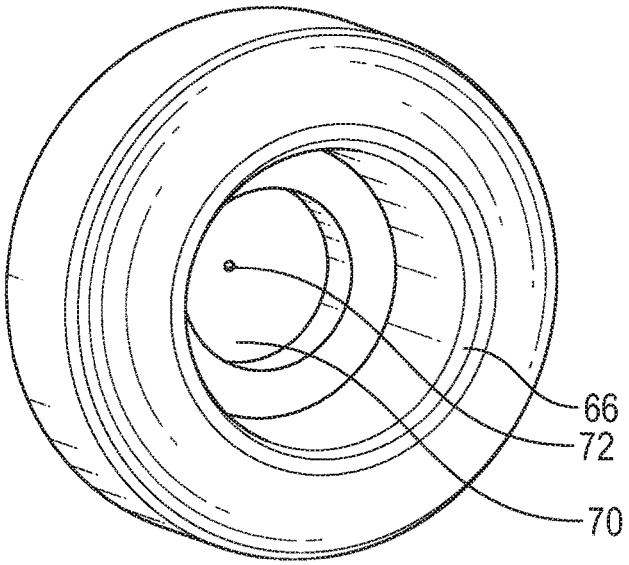
FIG. 13B is perspective view of the diaphragm of FIG. 13A.
Figure 13C:
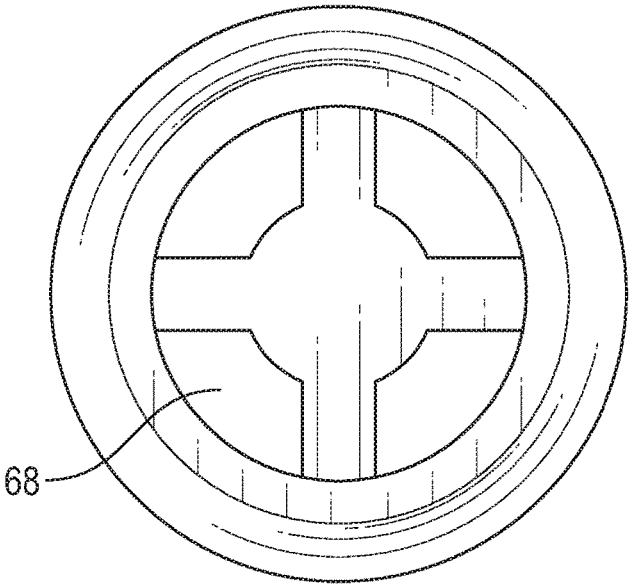
FIG. 13C is a front view of the push ribs of FIG. 13A.

Referring to FIG. 13, the vent structure can include as an alternative structure or in addition to the airlock and/or burp valve 64, a diaphragm 66 and associated push ribs 68 for engaging the diaphragm 66. Referring to FIG. 13A, the diaphragm 66 can be connected to the rear end of the barrel 12, positioned over the vent hole 56 in the barrel 12. Referring to FIG. 13B, the diaphragm 66 can have a dome shaped region 70 with an aperture 72 in the center of the dome shaped region 70. The aperture 72 generally aligns with the vent hole 56. The valve stem 28 can be modified to include push ribs 68. Alternatively, push ribs 68 can be attached to the rear end of the valve stem 28. When the valve stem is actuated, the push ribs contact the dome shaped region 70 of the diaphragm 68, pushing it towards the rear end of the barrel 12. As the dome shaped region 70 is displaced rearward, the aperture 72 increases in size, thereby allowing increase air flow form the vent hole 56. Referring to FIGS. 13A and 13C, in an embodiment, the valve stem 28 can include or have attached thereto four push ribs with that are separated to provide vent channels between the ribs. Other numbers of push ribs are also contemplated herein. The diaphragm 68 can be formed of any suitable material. For example, the diaphragm 68 can be formed of rubber or TPE.

Figure 14A:
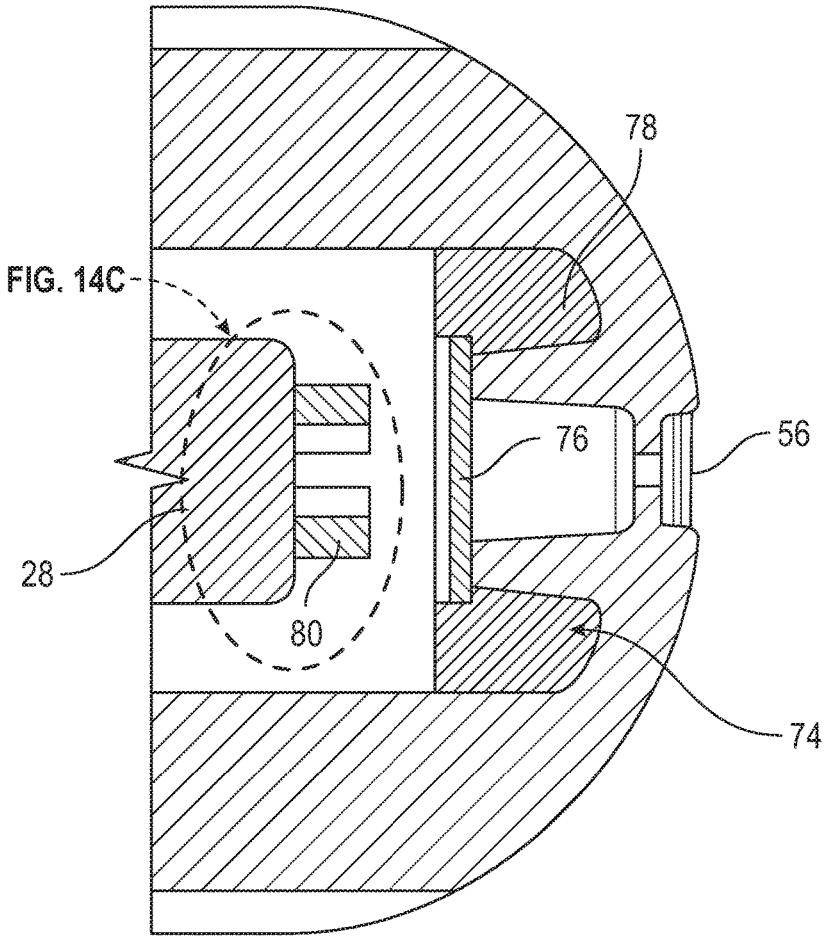
FIG. 14A is a cross-sectional view of a rear end of a writing instrument illustrating a vent structure in accordance with another embodiment of the disclosure.
Figure 14B:
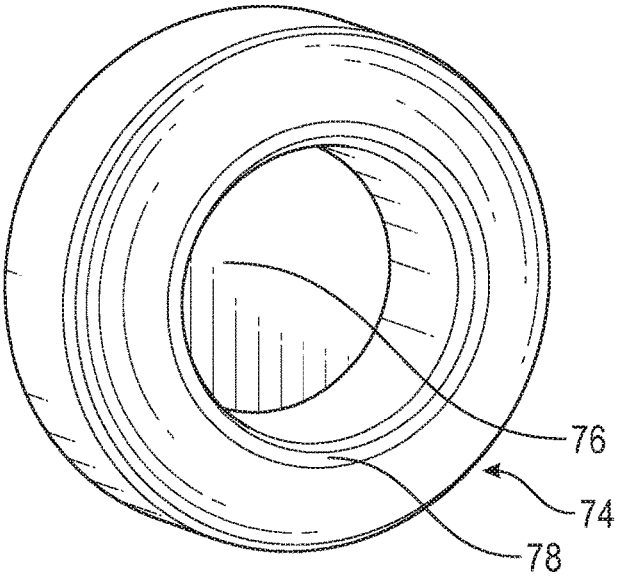
FIG. 14B is a perspective view of the mesh fabric and holder of FIG. 14A.
Figure 14C:
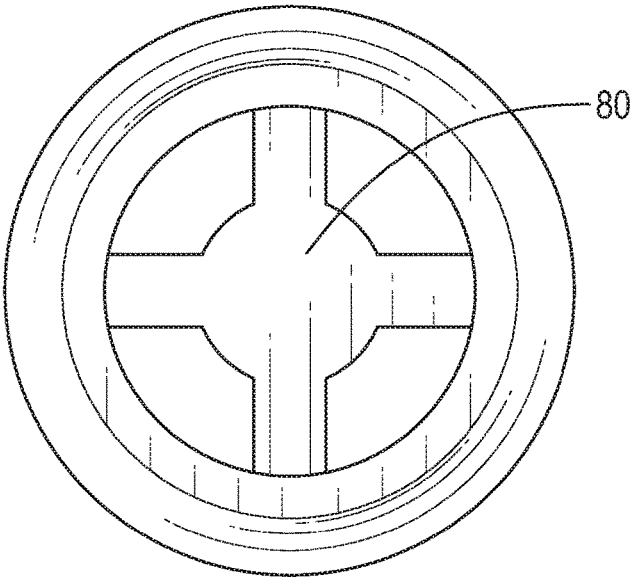
FIG. 14C is front view of the valve stem end of FIG. 14A.

Referring to FIG. 14, the vent structure can also alternatively or additionally include a mesh vent plug 74 that includes a mesh fabric 76 that is received in a holder 78. The mesh fabric allows air to pass through it, but can be formed of a material or treated to be hydrophobic and/or oleophobic so that it repels ink that leaks into the rear end of the barrel 12. For example, the mesh can be PTFE. The holder can be formed of an elastomeric material and can be received tightly in the rear end of the barrel 12. When a mesh vent plug 74 is utilized, push ribs 68 can be eliminated as illustrated in FIG. 14C. When the valve stem 28 is actuated, the end 80 of the valve stem presses against the mesh fabric forcing it toward the rear end of the barrel 12 and causing the openings in the mesh to expand to increasing air flow from the vent hole 56.

In accordance with various embodiments, the ink used in the writing instrument having a free-reservoir can be a lower viscosity ink, for example, a viscosity of 1 to 10 cP. Use of lower viscosity inks can aid in increasing priming speed and ease re-suspension. However, it is also contemplated herein that high viscosity inks can be used with such embodiments of the writing instrument, for example, viscosities up to 600 cP.

Spring Drive with Collapsible Reservoir

Figure 16:
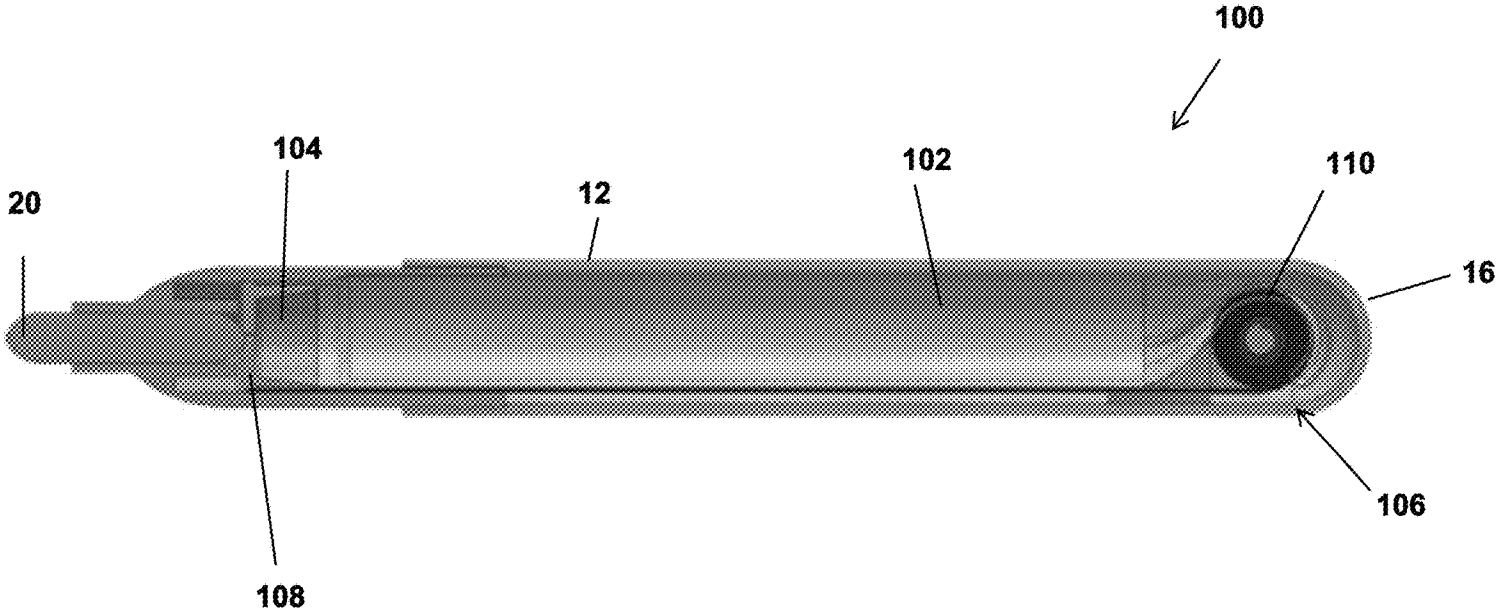
FIG. 16 is a side view of a writing instrument in accordance with another embodiment of the disclosure.

Referring to FIG. 16, in accordance with an embodiment, a writing instrument 100 can include a collapsing or collapsible reservoir 102 disposed within a barrel 12 and in fluid communication with a nib 20. A flow control element 104 can be disposed between the reservoir 102 and the nib 20 in some embodiments. In other embodiments, the nib 20 can serve to control the flow. The nib 20 can be wide and/or loose to aid in preventing clogging.

In an embodiment, the reservoir can be a collapsible reservoir 102. The reservoir can optionally include a fibrous fill (not shown). The reservoir 102 can be a progressively collapsing reservoir 102. Utilizing a reservoir 102 that is capable of collapsing with removal of the ink can eliminate or reduce solvent drain-back. Such a collapsible reservoir 102 can also operate in some embodiments without the need for venting.

Figure 17:
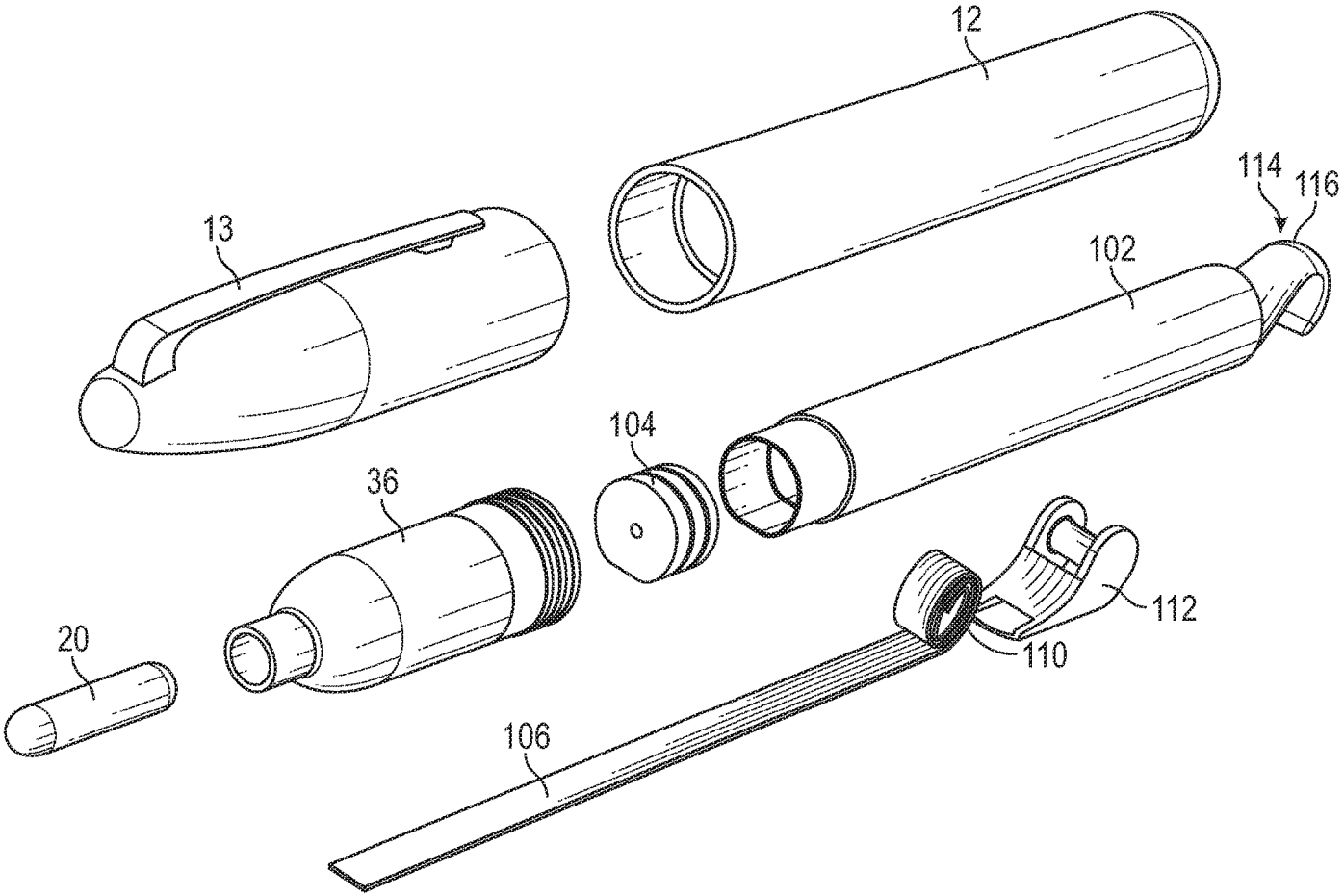
FIG. 17 is an exploded view of the writing instrument of FIG. 16.

A tensator spring 106 can be included to apply pressure to the reservoir 102 and collapse the reservoir 102 as ink flows out of the reservoir 102. An end of the tensator spring 106 can be fixed or otherwise secured at a front end 14 of the writing instrument 100 near the nib 20. The tensator spring 106 includes a coil 110 disposed opposite the fixed end 108. The coil 110 of the tensator spring 106 can be disposed at the rear of the reservoir 102, such that upon coiling of the spring 106 towards the fix front portion 108, the reservoir 102 is collapsed from the end disposed opposite the nib 20. Referring to FIG. 17, the tensator spring 106 can reside in a spring holder 112 that receives the coiled portion 110 of the spring 106. The spring holder 112 can also serve as a reservoir caddy, which is received by a portion of the reservoir 102. For example, as illustrated in FIG. 17, the reservoir 102 can include a terminal end 114 in the form of a clip or hook 116 that is engages a portion of the reservoir caddy 112. The spring holder 112 can move with the spring 106 as it is coiled and applies pressure to the reservoir 102.

As the spring 106 is coiled forward, pressure is applied to the reservoir 102, which in turn applies a pressure to the ink stored therein and draws the reservoir 102 closer to the nib 20 (collapsing the reservoir) as the ink is withdrawn from the reservoir 102. This can allow for application of high pressure in some embodiments. Pressures of 10,000 to 100,000 Pa can be generated, for example, by the tensator spring, gravity, and optionally reservoir back-pressure. Generation of high pressures can make such embodiments of the writing instrument 100 compatible with the use of strongly shear-thinning inks, yield-stress inks, and/or thixotropic inks. Such inks can be beneficial in reducing settling of the particles when the ink is stored within the writing instrument 100. The writing instrument 100 in accordance with this embodiment can accommodate inks having a wide range of viscosities, for example, from 1 cP to 600 cP. As discussed above, the writing instrument 100 can be used with Newtonian and non-Newtonian inks.

Figure 20:
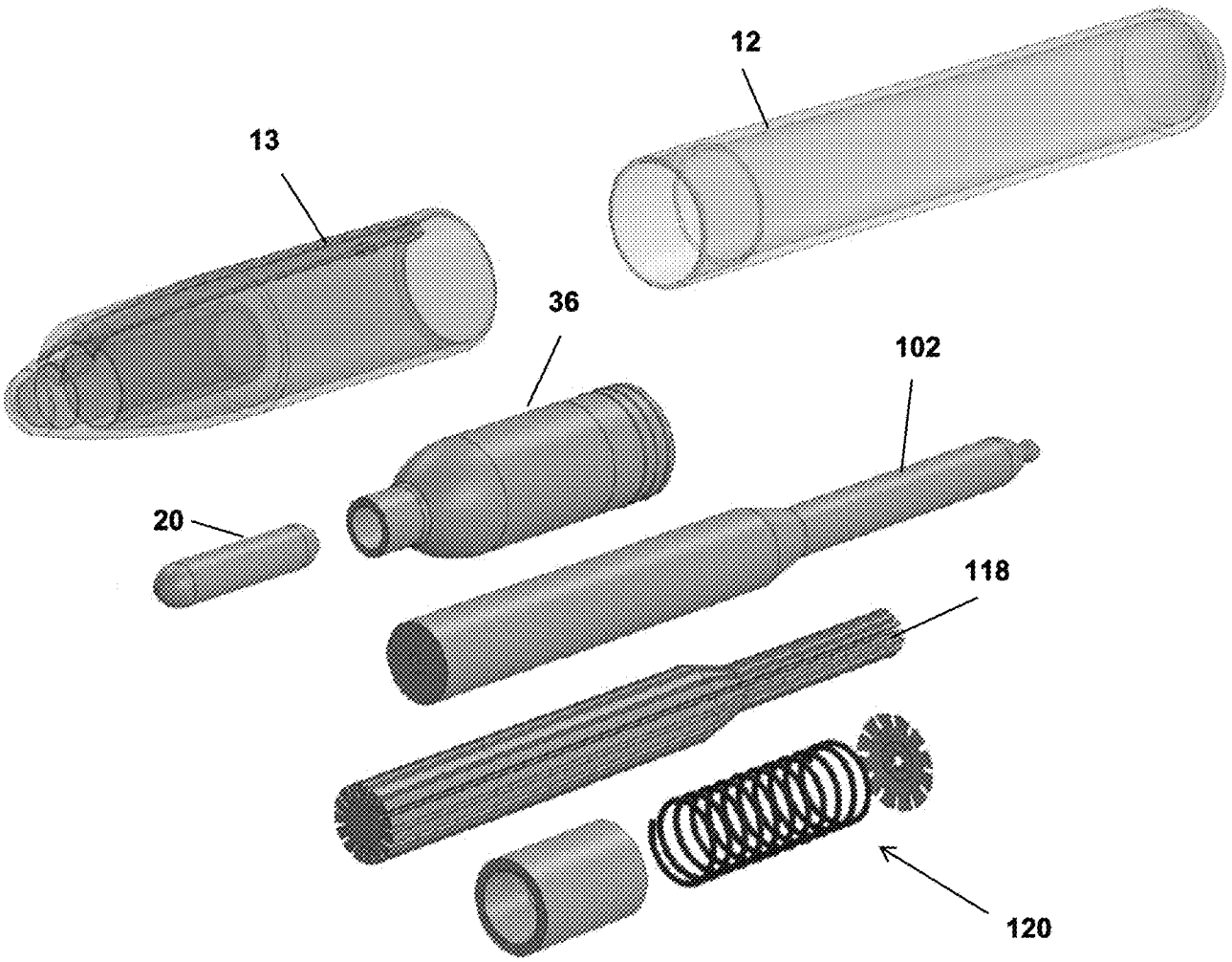
FIG. 20 is an exploded view of a writing instrument in accordance with yet another embodiment of the disclosure.

Referring to FIG. 20, in some embodiments, the reservoir 102 can include a fibrous fill 118. This can be useful, for example, with inks that are prone to aggregation. In such embodiments, the reservoir 102 can be attached to a spring assembly 120 at one end, which can apply pressure to the reservoir 102 when the nib 20 is actuated to generate pressure to flow the ink from the reservoir 102 to the nib 20. For example, the reservoir 102 can include a rear extension 122 that receives the spring assembly 120.

In either the embodiments of FIG. 17 or 20, the nib 20 can be actuated to engage the spring assembly 120 or tensator spring 106 associated with the reservoir 102 to apply any necessary pressure to flow the ink to the nib 20. For example, a drive pressure may be needed to flow inks, such as yield stress and thixotropic inks to flow out of the ink reservoir 102.

Figure 18:
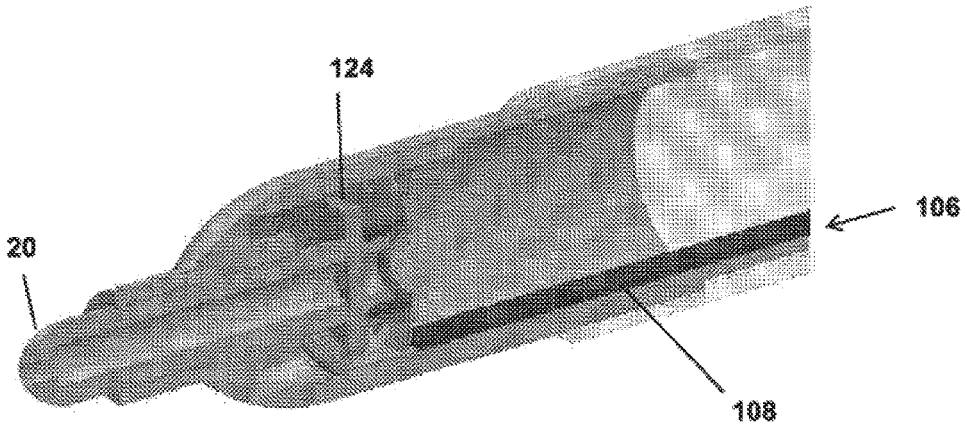
FIG. 18 is front, perspective cross-sectional view of the writing instrument of FIG. 16, showing the nib and a seal.
Figure 19A:
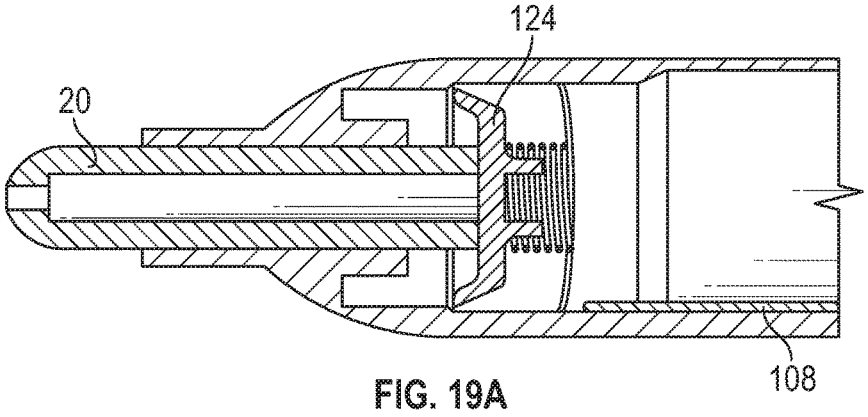
FIG. 19A is a side cross-sectional view of a portion of the writing instrument of FIG. 6, showing the nib and seal in the in-use position.
Figure 19B:
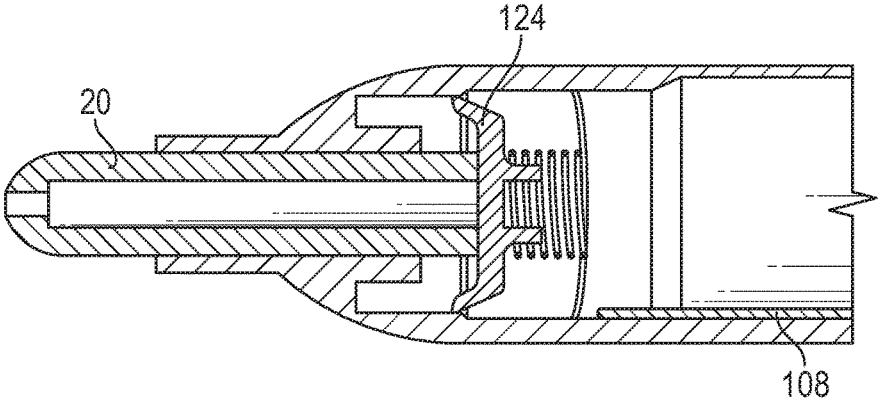
FIG. 19B is a side cross-section view of a portion of the writing instrument of FIG. 6, showing the nib and seal in the storage position.

Referring to FIG. 18, the nib 20 can be attached to or disposed adjacent to a seal 124 which can be spring actuated to seal the barrel 12 when the writing instrument 100 is not in use. FIGS. 19A and 19B illustrate the seal 124 in the "in use" position which the nib 20 is depressed, and the stored position, in which no force is applied to the nib 20, respectively.

In some embodiments, the writing instrument 100 can include an open vent (not shown) behind the reservoir to vent the system. In various embodiments, the use of the collapsible reservoir can avoid the need for a vent.

Such embodiments of the writing instrument 100 can deliver a near constant force of $1N/10^4$ Pa pressure over a large travel distance.

Air Pressure Drive

Figure 21:
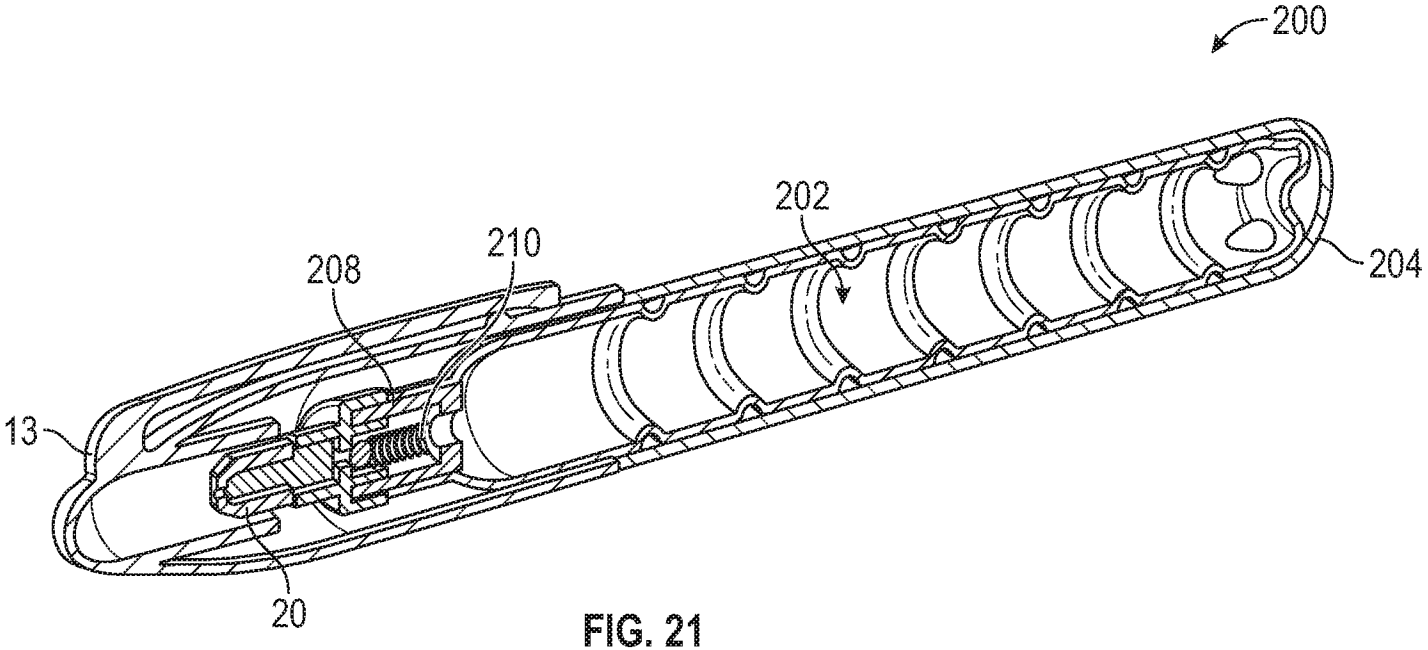
FIG. 21 is a perspective, cross-sectional view of a writing instrument in accordance with a still further embodiment of the disclosure.
Figure 22:
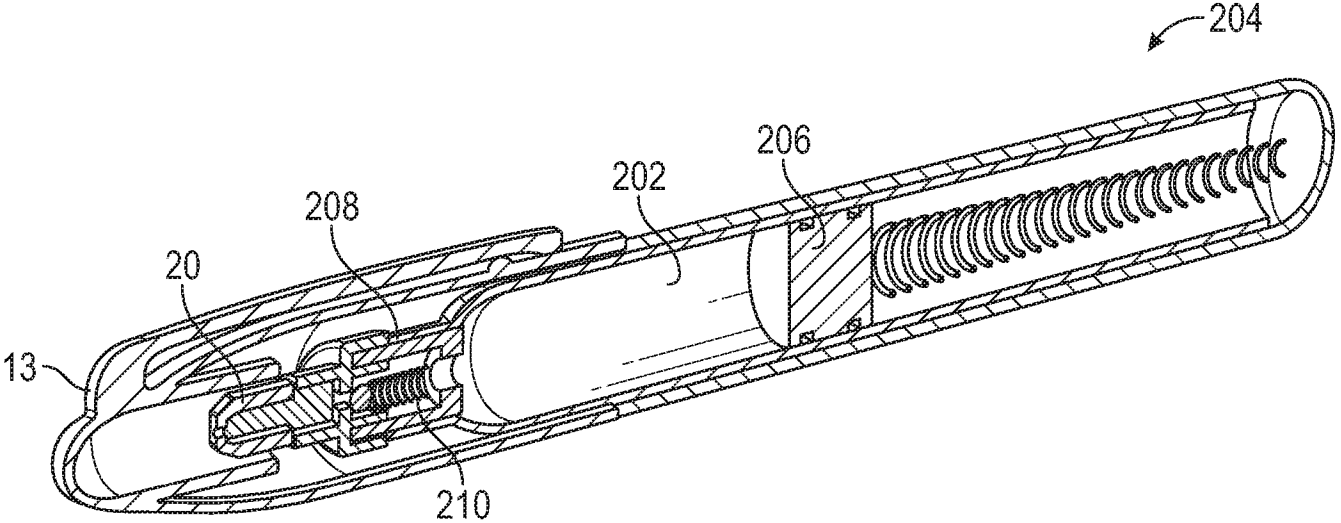
FIG. 22 is a perspective, cross-sectional view of a writing instrument in accordance with an embodiment of the disclosure.

Referring to FIGS. 21 and 22, in accordance with yet another embodiment of the disclosure, a writing instrument 200 can include a barrel 12 having an open reservoir 202 disposed therein that includes a pressure source 204. The pressure source 204 can be, for example, a pressurized gas and/or a piston driven source. The pressurized gas can be in direct contact with the ink in the reservoir 202. The gas volume when using a pressurized gas source will depend on the pressure needed. A suitable range can include, for example, about 1 ml to about 10 ml. The pressure source 204 can generate a pressure of up to 100,000 Pa. This high pressure generation can allow for the use of strongly shear-thinning inks, yield-stress inks, and thixotropic inks, which can have reduced settling of the pigment particles. Newtonian inks can also be used in a wide range of viscosities, for example from 1 cP to 600 cP.

The reservoir 202 can collapse due to gas expansion, which can allow for the use of a very loose nib without solvent drain-back. For example, as illustrated in FIG. 22, the movement of the piston 206 as the ink is removed from the reservoir 202 effectively shrinks the reservoir 202 volume. This can reduce or inhibit solvent drain-back because there is no free volume for the solvent to drain into.

Figure 23A:
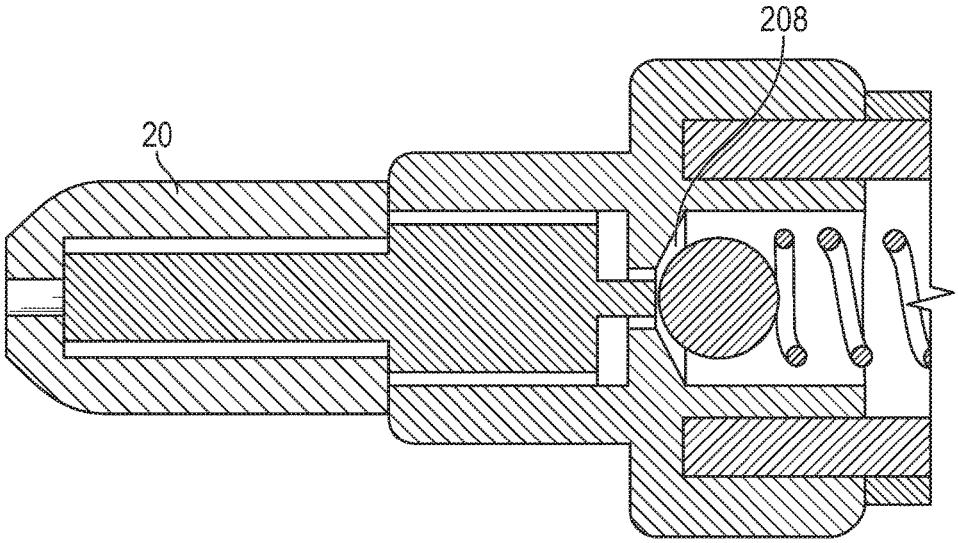
FIG. 23A is a cross-sectional view of a writing instrument nib and valve in accordance with an embodiment of the disclosure in the in use position.
Figure 23B:
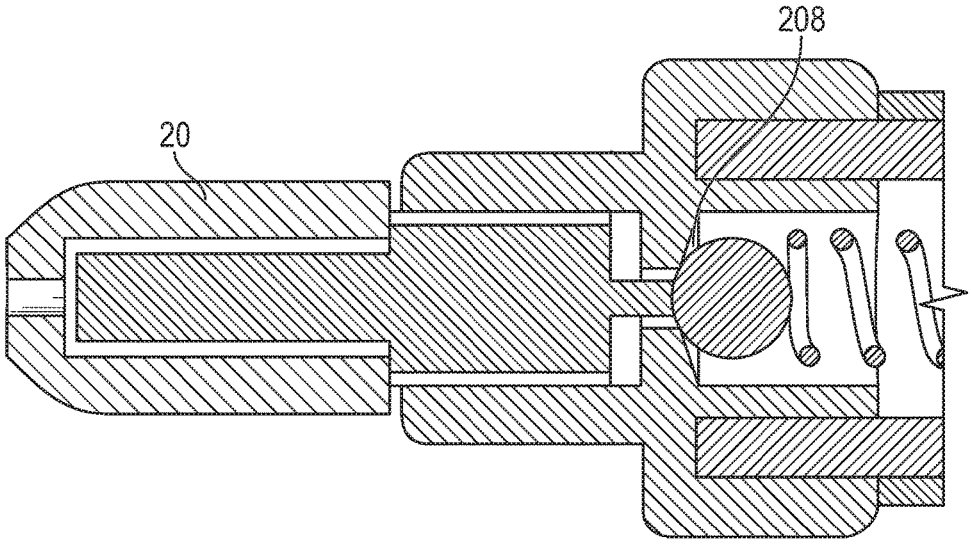
FIG. 23B is a cross-sectional view of the writing instrument nib and valve of FIG. 23A in the stored position.

FIG. 21 illustrates an embodiment in which the pressure source 204 is pressurized gas directly in contact with the ink (not shown) in the reservoir 202. FIG. 22 illustrates an embodiment in which the pressure source 204 is piston 206 driven Flow from the pressurized reservoir 202 can be controlled by actuation of a nib 20 that is in fluid communication with the reservoir 202. Referring to FIGS. 23A and 23B, the nib 20 can be attached to or can include a spring loaded valve 208 to control the flow from the reservoir 202. The valve 208 can be, for example, a ball valve. Actuation of the nib 20 by depression of the nib 20 (application of an axial force against a substrate, for example) can unseat the valve 208 (as shown in FIG. 23A) opening at least one passage between the reservoir 202 and the nib 20 through which the ink can flow. Referring to FIG. 23B, when no axial force is applied to the nib 20, a spring 210 biases the valve 208, for example, the ball, to seal the passage between the reservoir 202 and the nib 20, thereby preventing flow of the ink when the writing instrument is not in use.

In various embodiments, the nib 20 can be a wide and/or loose nib, which can prevent clogging during use with large pigment particle size containing inks.

The writing instrument 200 can further include a syringe and/or fiber bundle to aid in flow control.

The writing instrument 200 can be utilized with or without a vent. In embodiments in which the pressure is >1 bar, no venting is needed.

Baffled Nib

Figure 27:
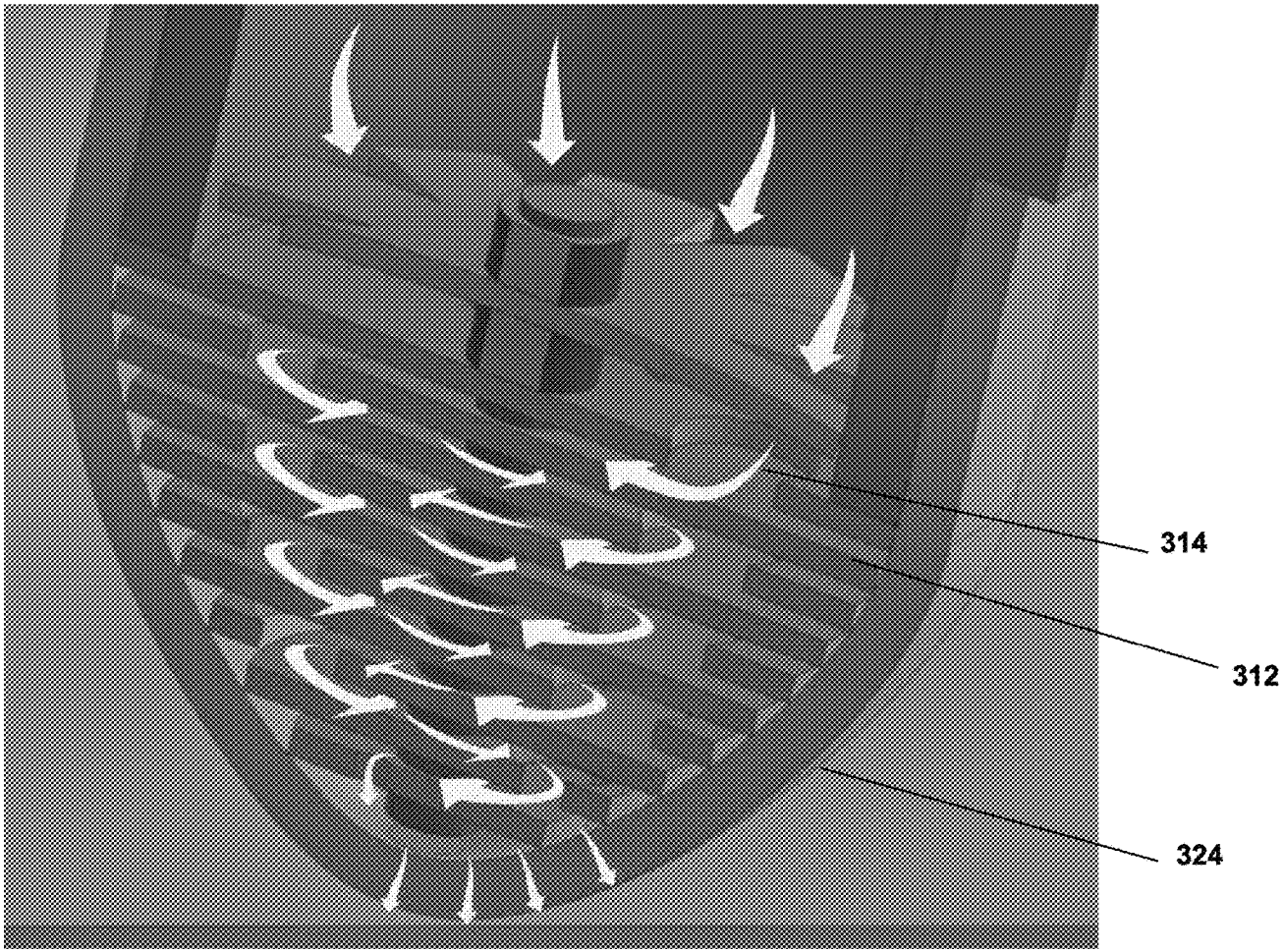
FIG. 27 is a cross-sectional view of a baffled nib in accordance with an embodiment of the disclosure.

Referring to FIG. 27, in accordance with yet another embodiment, a writing instrument 300 can be a lower-viscosity, capillary driven instrument with a soft non-fibrous nib 302 to trap particles during drain-back. In some aspects, the nib 302 can be provided for use with conventional writing instrument designs.

In an aspect, the nip 302 can be a short, open fibrous nib with a central feed hole 304. The nib 302 can be formed, for example, by binding fibers with resin onto a solid backing.

Figure 26:
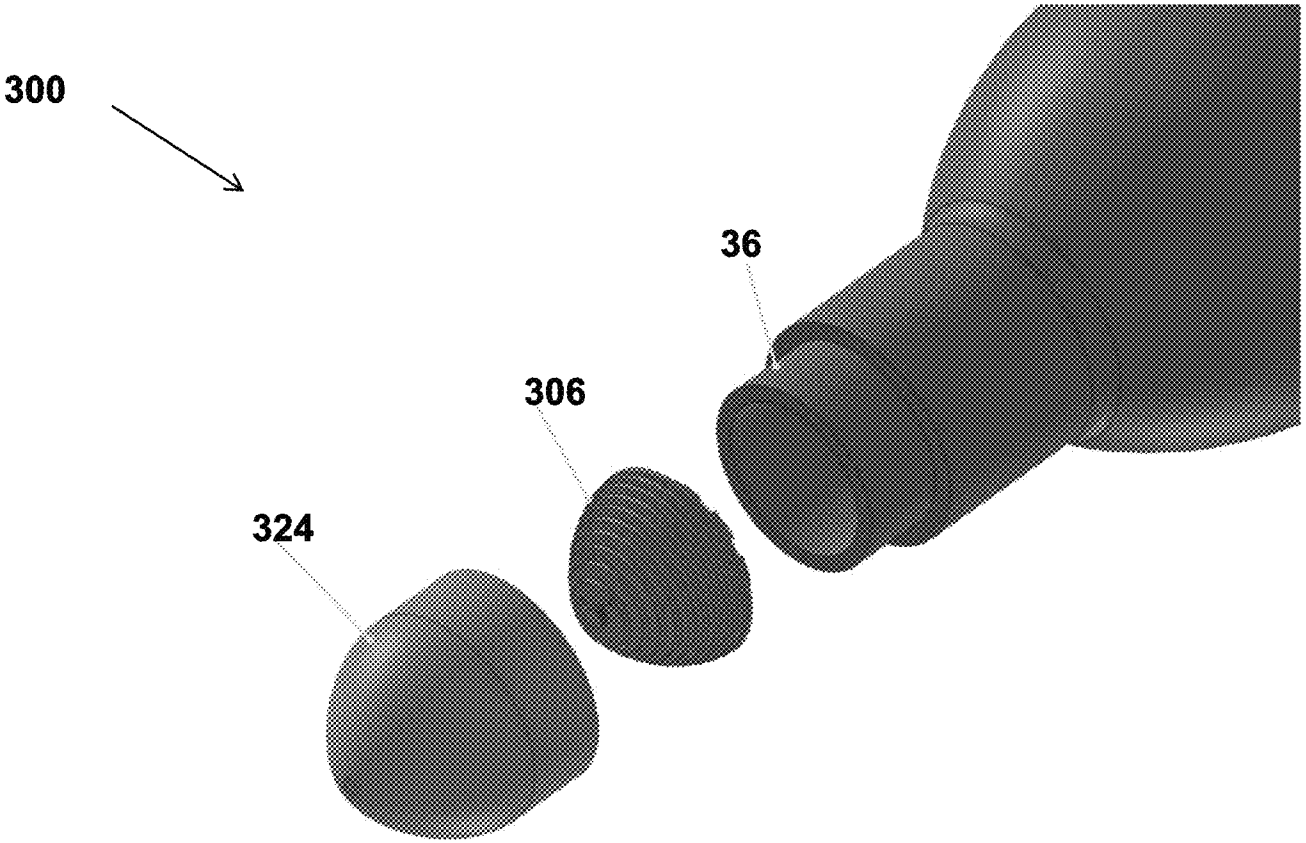
FIG. 26 is an exploded view of a nib in accordance with an embodiment of the disclosure.

Referring to FIG. 27 in accordance with an embodiment a nib 302 can include a baffle assembly 306 and a porous writing tip 308. The baffle assembly 306 can aid in reducing or eliminating pigment drain-back (shown in FIGS. 25 and 26). For example, the baffle assembly 306 can create horizontal channels 310 in which the pigment resides and is prevented from draining back into the reservoir even when the instrument 300 is oriented in a tip-up position. This can allow the pigment to remain available in the nib 302 and improve delivery of the pigment to a substrate even after storage in the tip-up configuration.

Figure 28:
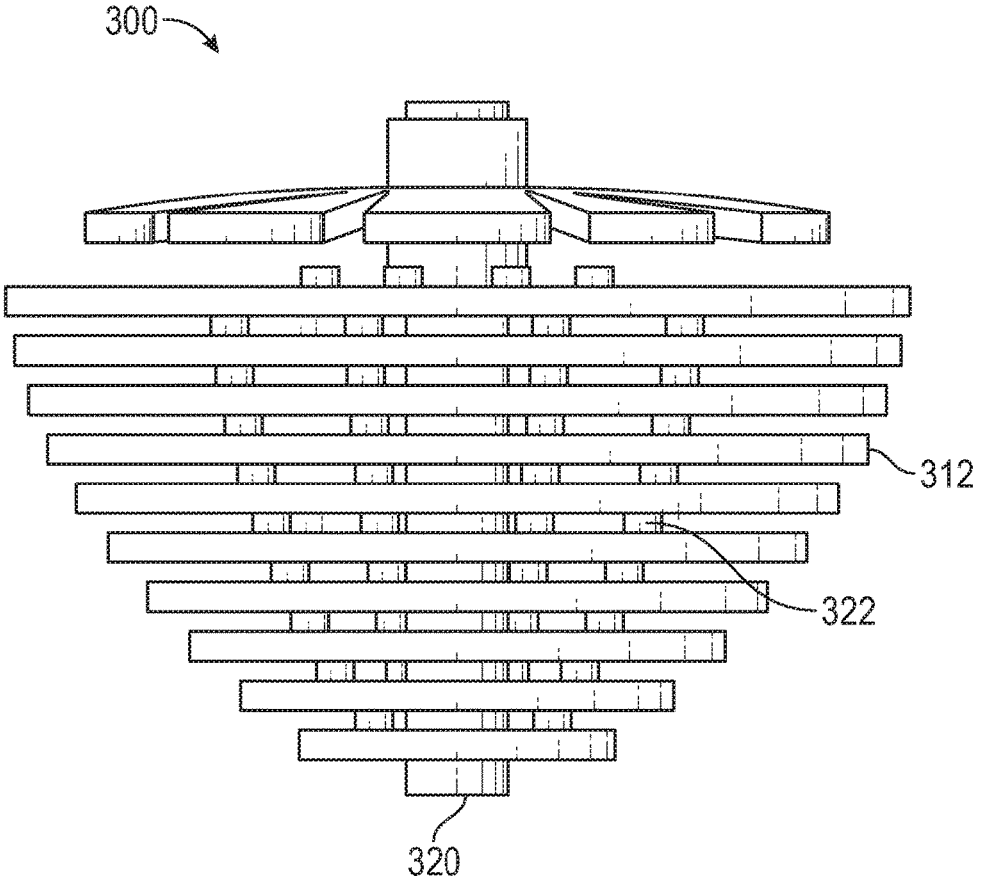
FIG. 28 is a front view of a baffled nib in accordance with an embodiment of the disclosure.

As illustrated in FIG. 28, the baffle 306 includes multiple layers defining horizontal channels 310 within the structure. The layers 312 of the baffle are interconnected by holes 314 that draw the ink to flow horizontally. The spacing between the layers 312 of the baffle 306 can vary depending on the ink used, but needs to be large enough to allow the pigment particles to flow without blocking the channels 310 but small enough to minimize settling time.

Figure 29:
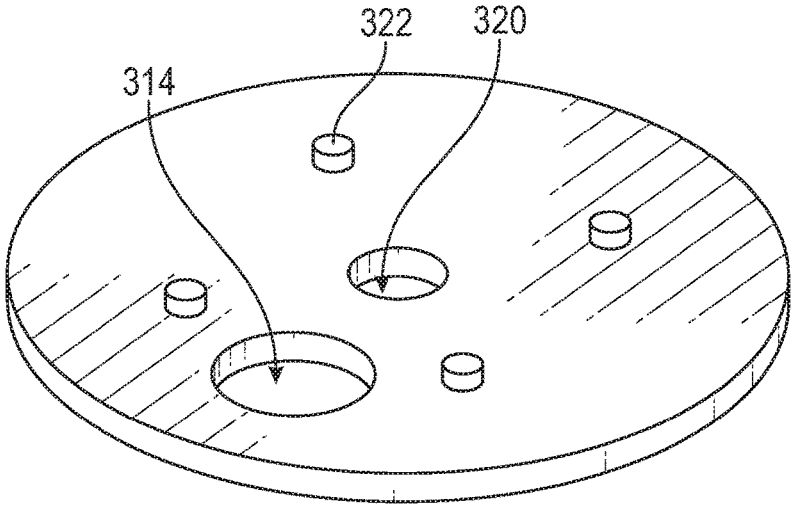
FIG. 29 is a perspective view of a single plate of the baffled nib of FIG. 27.

The baffle 306 can be manufactured in a variety of ways. For example, in an embodiment, the baffle 306 can be manufactured, for example molded as a unity piece. In other embodiments, the baffle 306 can be manufactured as individual pieces that are assembled along a central core or spine 316 to define the baffle 306. Referring to FIG. 29, for example, the individual layers 312 or plates of the baffle 306 can be molded or formed using other known methods, such as acid etching and then assembled along a central core 316. The layers 312 of the baffle 306 can be attached or adhered to the central core 316. Alternatively a washer 318 can be used to retain the layer assembly in place, as shown in FIG. 29.

Figure 30:
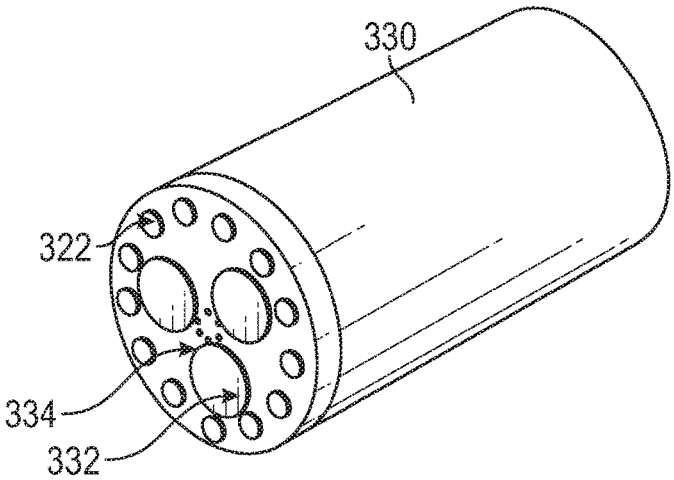
FIG. 30 is a perspective view of a nib in accordance with an embodiment of the disclosure.

Referring to FIG. 30, each layer 312 or plate of the baffle 306 can include a hole 314 for flow of the ink, a hole 320 for the central core 316, and one or more spacers 322 to maintain the desired spacing between the layers 312 to allow flow of the pigment without clogging. For example, in an embodiment, the one or more spacers 322 can have a thickness of approximately 100 microns to provide 100 micron spacing between the layers 312 of the baffle 306.

In some aspects, the baffle nib 302 is in fluid communication with a conventional fibrous reservoir. In other aspects, the baffle nib 302 can be in fluid communication with an open reservoir. A baffle nib 302 in accordance with embodiments of this disclosure can be incorporated as a replacement nib for conventional writing instruments, allowing such conventional writing instruments to be adapted for use with large-pigment particle containing inks.

A nib 324 covering can be disposed around the baffle 306 to provide a writing tip. The nib covering 324 material can be molded, sintered, nonwoven, or other such structures. The nib material or covering 324 can conform to the shape of the nip portions or layers or can define a distinct shape. For example, in an embodiment, both the covering and the baffled portions are substantially conically shaped. In an embodiment, the covering can be substantially conically shaped, while the baffled portion is cylindrically shaped.

The baffle 306 can be formed of a variety of materials. For example, a flexible material such as PDMS can be used. In such embodiments, the baffle 306 can be held in place against the reservoir using a retaining clip, for example.

FIGS. 27 and 28 illustrate an embodiment in which a portion of the baffle assembly 306 can be received in a ferrule 36 of the writing instrument, with the first plate 326 of the baffle 306 residing against the edge of the ferrule 36. Other known means of retaining a nib in the instrument barrel are also completed herein and can be suitable for use with the baffled nib 302 disclosed herein.

Figure 31:
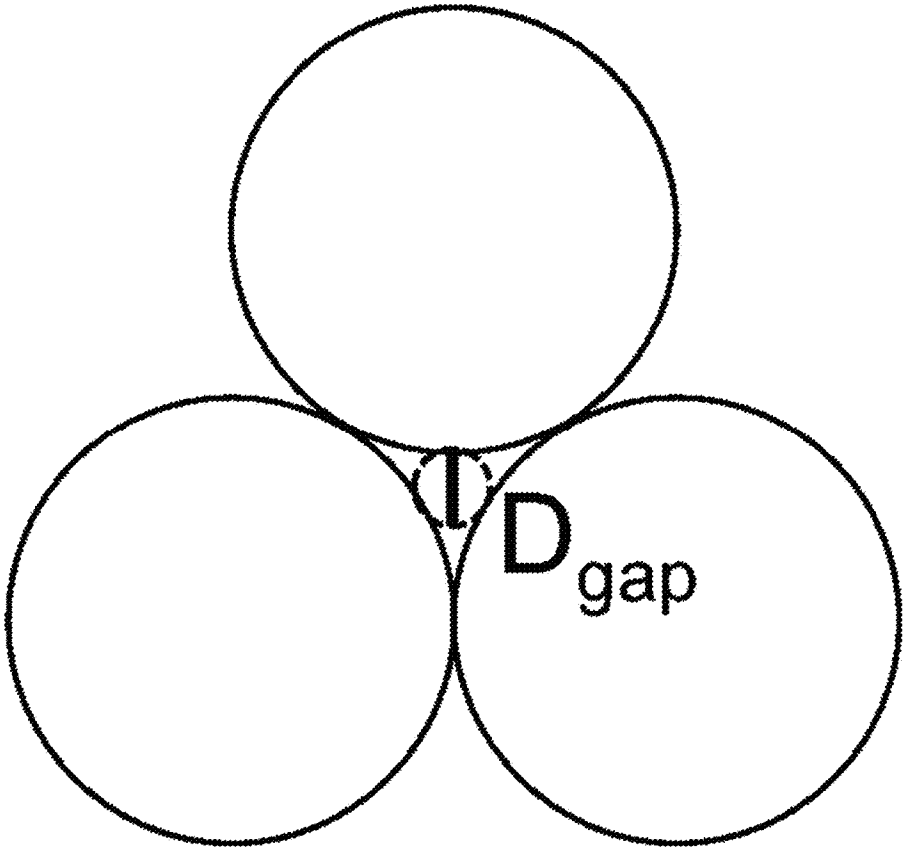
FIG. 31 is a schematic drawing of a nib formed from a fiber bundle.

FIG. 31 illustrates a nib layer 328 attached to a fibrous reservoir 330. The nib layer 328 can include securing pins 332 and one or more feed holes 334 to fluidly couple the reservoir 330 and the nib layer 328. The nib layer 328 can further include spacers 322. The spacers can be disposed, for example, around the perimeter of the nib layer 328. In some embodiments, a nib layer 328 can be provided in series with additional nib layers 328 to provide additional baffling. In such embodiments, the feed holes 334 of each layers 328 can be misaligned as illustrated in FIG. 30, for example.

In embodiments having multiple nib layers 328, the nib layers can be tapered as illustrated in FIG. 30 to form a generally conically shaped nib. In other embodiments, the nip with multiple nib layers 328 can have layers of the same diameter such that there is no tapered shape. For example, the stacked nip layers 328 can have a generally cylindrical shape. In some embodiments, only a single nib layer 328 can be used for baffling.

In accordance with an embodiment, a writing instrument 300 having a baffled nib with 100 microns of separation between layers or plates can limit pigment drain-back time to approximately 10 seconds at sedimentation velocities of about 10 μm/s, which is typically of metal pigments having diameters of about 10 microns.

Baffled nibs as described herein can be incorporated in exiting writing instrument structures, including fibrous reservoir based instruments, free-ink reservoir based instruments, and other conventional instrument designs. Such baffled nibs can accommodate inks having a viscosity, for example, of about 1 cP to about 10 cP. Pressure within the instrument is provided by capillary pressure and gravity and can be approximately 100 Pa net with reservoir back-pressure.

Although certain delivery systems and writing instruments have been described herein in accordance with the teaching of the present disclosure, the scope of the coverage of this patent is not limited thereto. On the contrary, while the invention has been shown and described in connection with various preferred embodiments, it is apparent that certain changes and modifications, in addition to those mentioned above, may be made. This patent covers all embodiments of the teachings of the disclosure that fairly fall within the scope of permissible equivalents. Accordingly, it is the intention to protect all variations and modifications that may occur to one of ordinary skill in the art.

What is claimed:

1. A writing instrument, comprising:

a barrel having a barrel first end and an oppositely disposed barrel second end, wherein a vent hole is disposed in the barrel second end;

an ink reservoir disposed within the barrel;

a writing nib in fluid communication with the ink reservoir;

a valve comprising a valve first end and an oppositely disposed valve second end;

a valve stem having a stem first end and an oppositely disposed stem second end, wherein the stem first end is coupled to the valve and a vent valve is disposed at the stem second end, the vent hole and the vent valve collectively forming a vent; and an agitator disposed on the valve stem, wherein:

the nib is coupled to the valve at the valve first end and the valve stem is coupled to the valve at the valve second end, the nib is adapted to actuate to shift the valve between first and second positions, and when in a first position the valve is disposed in the barrel such that at least a surface of the valve seals against an internal surface of the barrel to prevent flow between the ink reservoir and the nib, and when in a second position, the valve is shifted to open one or more passages through which a fluid can flow from the ink reservoir to the nib.

2. The writing instrument of claim 1, wherein the agitator is a vane disposed on the valve stem.

3. The writing instrument of claim 1, wherein the agitator is slidably disposed on the valve stem such that the agitator is adapted to move linearly along the valve stem and rotate.

4. The writing instrument of claim 3, wherein the agitator is formed of stainless steel or aluminum.

5. The writing instrument of claim 3, further comprising one or more stops for constraining the linear movement of the agitator.

6. The writing instrument of claim 5, wherein the one or more stops are disposed on the valve stem.

7. The writing instrument of claim 1, wherein the vent comprises an airlock that seals the ink reservoir when the valve stem is in the first position and opens to allow passage of gas to vent the reservoir when the valve stem is in the second position.

8. The writing instrument of claim 1, wherein the vent valve is a burp valve disposed on the valve stem.

9. The writing instrument of claim 1, wherein the vent valve comprises a diaphragm having an aperture, the diaphragm being attached to the second end of the barrel over the vent hole and one or more push ribs disposed on the valve stem and adapted to contact the diaphragm when the valve stem is in the second position thereby expanding the aperture in the diaphragm.

10. The writing instrument of claim 1, wherein the vent valve comprises a mesh fabric disposed in an elastomeric holder, the elastomeric holder being disposed in the barrel second end over the vent hole, wherein the stem second end is adapted to contact the mesh fabric when the valve stem is in the second position, thereby expanding openings in the mesh fabric.

11. The writing instrument of claim 10, wherein the mesh fabric is or is treated to be hydrophobic and/or oleophobic.

12. The writing instrument of claim 1, wherein the nib further comprises a rigid adapter disposed around a portion of the circumference of the nib.

13. The writing instrument of claim 1, wherein a spring biases the valve stem in the first position and actuation of the valve stem to the second position compresses the spring.

14. The writing instrument of claim 13, wherein the spring is disposed around a stem clip attached to the valve stem.

15. The writing instrument of claim 14, further comprising a collector disposed in an aperture of the stem clip to absorb ink disposed in the vicinity of the stem clip.

16. The writing instrument of claim 1, comprising an ink having pigment particles with an average diameter of greater than 8 microns.

17. The writing instrument of claim 1, wherein the ink reservoir is free of a fibrous fill.

18. The writing instrument of claim 1, wherein the ink reservoir is defined by an inner wall of the barrel.

19. A writing instrument, comprising:

a barrel having a barrel first end and an oppositely disposed barrel second end;

an ink reservoir disposed within the barrel;

a writing nib in fluid communication with the ink reservoir;

a valve comprising a valve first end and an oppositely disposed valve second end; a valve stem having a stem first end and an oppositely disposed stem second end, wherein the stem first end is coupled to the valve; and an agitator disposed on the valve stem, wherein:

the nib is coupled to the valve at the valve first end and the valve stem is coupled to the valve at the valve second end, the nib is adapted to actuate to shift the valve between first and second positions, when in a first position the valve is disposed in the barrel such that at least a surface of the valve seals against an internal surface of the barrel to prevent flow between the ink reservoir and the nib, and when in a second position, the valve is shifted to open one or more passages through which a fluid can flow from the ink reservoir to the nib, and a spring disposed around a stem clip attached to the valve stem biases the valve stem in the first position and actuation of the valve stem to the second position compresses the spring.

20. The writing instrument of claim 19, further comprising a collector disposed in an aperture of the stem clip to absorb ink disposed in the vicinity of the stem clip.

* * * * *